US007540102B2

(12) United States Patent
Olmr et al.

(10) Patent No.: US 7,540,102 B2
(45) Date of Patent: Jun. 2, 2009

(54) SNOW BLOWER APPARATUS

(75) Inventors: Jaroslav J. Olmr, Shebogan, WI (US); Richard M. Olmr, Prostejov (CS)

(73) Assignee: Wisconsin Engineering, CZ s.r.o., Prague (Kbely) (CZ)

( * ) Notice: Subject to any disclaimer, the term of this patent is extended or adjusted under 35 U.S.C. 154(b) by 562 days.

(21) Appl. No.: 11/239,509

(22) Filed: Sep. 28, 2005

(65) Prior Publication Data

US 2006/0218823 A1 Oct. 5, 2006

(30) Foreign Application Priority Data

Mar. 2, 2005 (CS) ..... 2005-16347
Mar. 2, 2005 (CS) ..... 2005-16348

(51) Int. Cl.
*E01H 5/09* (2006.01)

(52) U.S. Cl. ..... 37/245; 37/249; 37/382

(58) Field of Classification Search ..... 37/245, 37/249, 348, 382, 414, 247
See application file for complete search history.

(56) References Cited

U.S. PATENT DOCUMENTS 3,808,715 A 5/1974 Haban
4,104,812 A 8/1978 Stribiak, Jr.
4,289,224 A 9/1981 Dobberpuhl
5,138,824 A * 8/1992 Oshima et al. ..... 56/10.2 R
5,651,241 A * 7/1997 Wegner ..... 56/11.2
5,735,064 A 4/1998 Holl
6,098,385 A * 8/2000 Turk ..... 56/11.3
6,131,316 A * 10/2000 Yoshina et al. ..... 37/242
6,155,033 A * 12/2000 Wians et al. ..... 56/11.1
6,550,161 B2 * 4/2003 Hanafusa et al. ..... 37/246
6,564,481 B2 * 5/2003 Wakitani et al. ..... 37/348
6,643,959 B2 11/2003 Jolliff et al.
6,651,529 B1 * 11/2003 Poplawsli et al. ..... 74/607
6,662,477 B2 12/2003 Dowe et al.
6,742,290 B2 6/2004 Hanafusa
6,860,348 B2 3/2005 Wakitani et al.
6,874,320 B2 4/2005 Sakikawa
6,895,748 B2 * 5/2005 Williams et al. ..... 60/494
6,977,473 B2 * 12/2005 Wakitani et al. ..... 318/64
7,305,778 B2 * 12/2007 Wakitani et al. ..... 37/245
2001/0032447 A1 10/2001 Jolliff et al.
2002/0108274 A1 * 8/2002 Dowe et al. ..... 37/257
2002/0116922 A1 * 8/2002 Abend et al. ..... 60/435
2003/0085680 A1 5/2003 Wakitani et al.
2003/0177669 A1 9/2003 Beaudoin
2004/0118115 A1 * 6/2004 Bird et al. ..... 60/468
2004/0148819 A1 * 8/2004 Hanafusa et al. ..... 37/348
2004/0227348 A1 11/2004 Wakitani et al.

(Continued)

OTHER PUBLICATIONS http://www.hondapowerequipment.com/snowhe.asp, Last viewed: Sep. 13, 2005.

*Primary Examiner*—Thomas A Beach
(74) *Attorney, Agent, or Firm*—Wilhelm Law Science; Thomas J. Connelly

(57) ABSTRACT

A snow blower has an adaptive speed control, optionally an open carrier differential, which is optionally selectively lockable. The auger is preferably chain driven. The engine output shaft optionally has a first fixedly secured pulley and a second clutched pulley. The discharge chute can be guided in rotation by an idler wheel. The chute can be rotatably actuated by a cable assembly controlled by a rotatable handle.

11 Claims, 11 Drawing Sheets

U.S. PATENT DOCUMENTS

2005/0029816 A1 2/2005 Brandon et al.
2005/0090949 A1 4/2005 Wakitani et al.
2005/0097788 A1* 5/2005 Wakitani et al. ..... 37/348
2006/0123667 A1* 6/2006 Mizoroke et al. ..... 37/257
2007/0022636 A1* 2/2007 Wakitani et al. ..... 37/245

* cited by examiner (961) IGNITION SWITCH BOX

| POSITION | FUNCTION | CONTACT |
|---|---|---|
| 1 | OFF | G+M |
| 2 | RUN | B+L |
| 3 | START | B+L+S |

SNOW BLOWER APPARATUS

CROSS-REFERENCE TO RELATED APPLICATIONS

This application claims foreign priority under 35 U.S.C. 119 to Czech Republic (CZ) Application No. PUV 2005-16347 filed Mar. 2, 2005, and Czech Republic (CZ) Application No. PUV 2005-16348 filed Mar. 2, 2005, both of which are incorporated by reference in their entirety.

BACKGROUND

The present invention relates generally to relatively small implement machines and more particularly to machines used to remove snow from e.g. sidewalks, driveways, and/or from other surfaces which a user desires to clear of snow. Such machines are frequently referred to by names such as snow blowers, snow throwers, and others.

Some snow blowers are user propelled, or non-self propelled. Such snow blowers advance and/or regress under the power of the user, whereby the user pushes, pulls, or otherwise manipulates the device as desired.

By contrast, some snow blowers are self propelled devices, whereby the device advances and/or regresses at least partially under its own power. These self propelled snow blowers can be relatively easier to use, as compared to non-self propelled snow blowers. As one example, a user can devote relatively less energy to advancing the snow blower forward, and can concentrate more energy toward e.g. steering the device, laterally controlling, and/or otherwise controlling, the device.

Typical self propelled snow blowers have an engine, a pair of drive wheels, an auger, and a discharge chute. The engine provides power to all power requiring components of the snow blower, namely the drive wheels and the auger.

A typical method to transmit power from the engine to the drive wheels is by way of a friction drive, solid axle, and sleeved or other wheel hubs. The friction drive includes a drive disc or platter which is rotatably driven by the power produced by the engine. When the friction drive is engaged, an outwardly facing surface of the drive disc or platter frictionally engages the outer circumferential surface of a wheel or other circumferentially-defined surface which is fixedly mounted to the solid axle.

The user engages the friction drive by way of a belt tensioning mechanism which includes one or more belts. Such belts are prone to slippage, breakage, and/or other failure over time. The belt tensioning mechanism is actuated by depressing a drive-lever located on a handlebar.

Depressing the drive-lever can require substantial force. Plus, to keep the friction drive engaged, the user must continuously hold the drive-lever in the depressed, engaged, position, against a substantial retractive force, whereby the use of such friction drive can prove tiresome for the user.

Still referring to known technology, one of the drive wheels is fixedly attached to the solid axle. The other wheel rotates freely with respect to the solid axle, e.g. is a free wheel assembly. Specifically, the free wheel assembly includes a cylindrical hub-sleeve portion which extends axially outwardly from a central portion thereof. The inside diameter of the free wheel hub-sleeve is larger than the outside diameter of the solid axle, enabling the hub-sleeve to slide concentrically over the end of the solid axle.

As desired, the hub-sleeve of the free wheel is rotatably connected to the solid axle by way of, for example, an engaging pin, inserted through bores which extend radially through the hub-sleeve and the solid axle. Accordingly, to disengage a wheel from its rotatable connection with the axle, a user removes the respective engagement pin from the assemblage of the axle and wheel. Then, to reengage the wheel into a rotatable connection with the axle, the user aligns the holes in the axle and sleeve, and reinserts the engagement pin.

However, removing and/or reinserting the engagement pin can prove relatively difficult, at least in certain circumstances and/or environmental conditions. As one example, the corresponding bores of the wheel hub sleeve and the solid axle must be in suitable alignment, both radially and axially, to enable a user to insert an engagement pin therethrough. This task can be further complicated by certain factors such as limited lighting conditions, snow and/or ice which can accumulate in the bores, poor user dexterity if the user wears mittens or gloves, or under cold ambient temperature exposure to bare skin if the user does not wear mittens or gloves, or others.

A typical auger mechanism is driven by a worm and gear, e.g. worm gear type, drive which interfaces the auger at a medial portion thereof. Specifically, in many two-stage auger mechanisms, in which the auger defines a first stage and an impeller defines a second stage, a shaft is driven by power from the engine and extends axially through the center of an impeller. This shaft rotates the impeller and extends axially outwardly beyond the impeller.

The end of this shaft includes a worm gear which is adapted and configured to rotatably drive a corresponding gear that is keyed, or otherwise fixedly connected to, a medial portion of the auger. Thus, when the impeller rotates, so does the auger.

However, worm gear drive configurations, which interface with the medial portion of the auger, define a portion of the auger which is not occupied by the auger blade. Namely, the worm gear drive is generally encapsulated by a housing structure. The housing is typically located in the middle-most portion of the auger, and extends radially outwardly from the auger shaft.

The auger blade which extends spirally outwardly from the auger shaft is discontinuous along the entire length of the auger. In other words, a typical auger defines a center-most portion where the worm gear drive housing is located, and first and second auger blade portions which extend laterally outwardly from respective lateral sides of the worm gear drive housing. The first and second auger blade portions are capable of removing snow along their respective paths of travel; whilst the worm gear drive housing defines an uncut path of remaining snow along its respective path of travel.

Similar to the engagement of the means for engaging the friction drive to provide power to the drive wheels, the conventional auger mechanism is typically engaged by a belt tensioning mechanism which includes one or more belts. These belts are also prone to slippage, breakage, and/or other failure over time.

As with the conventional friction wheel drive mechanism, the belt tensioning mechanism of the auger is actuated by depressing a drive-lever located on a handlebar. Depressing the drive-lever can require substantial force. Plus, to keep the auger drivingly engaged, the user must continuously hold the auger-lever in the depressed, engage, position, whereby the use of such auger drive mechanism can prove tiresome for the user. And when the user releases the auger-lever, the auger and impeller tend to spin until the inertial energy of the rotating parts has suitably been depleted, which can prove dangerous for the user and/or others in the vicinity of the snow blower.

On a conventional snow blower, the snow discharge chute has a lower portion with a generally cylindrical outer wall defining a generally cylindrical inner passage. The outer wall includes a circular flange which extends radially outwardly therefrom, adjacent the bottom of the discharge chute. The circular flange includes a toothed flange gear which interfaces with a corresponding worm gear. The worm gear and flange gear enable a user to rotate the snow discharge chute by rotating the worm gear and thus the flange gear.

The circular flange is rotatably mounted within an annular housing which has a housing lower plate and a housing upper plate which are spaced vertically from each other. Namely, the circular flange is rotatably mounted between the upper and lower housing plates.

Typically, the circular flange and the upper and lower housing plates are made from ferrous, e.g. steel and other, materials. Such materials are susceptible to rust and/or other corrosion. In addition, in light of the intended use environment, the circular flange and the upper and lower housing plates are vulnerable to freezing together. Accordingly, these components of the snow discharge chute are prone to e.g. rusting together, and/or otherwise realizing an increase in the amount of friction therebetween, which compromises the ability of a user to rotate the discharge chute according to its intended function.

Accordingly, there are times when it might be desirable to provide snow blower machines and/or apparatus which include a snow discharge chute rotatably mounted on idler wheels. In addition, it might prove desirable to provide snow blower machines and/or apparatus which include a cable actuated snow discharge chute assembly.

It might prove beneficial to provide snow blower machines and/or apparatus which include an axle assembly with a differential mechanism.

It might prove beneficial to provide snow blower machines and/or apparatus with a selectively lockable differential mechanism.

It might prove beneficial to provide snow blower machines and/or apparatus with a chain drive auger that realizes generally no uncut path along the length of such auger.

It might prove beneficial to provide snow blower machines and/or apparatus with an adaptive speed control mechanism which requires relatively less user energy input to operate.

It might prove beneficial to provide snow blower machines and/or apparatus with a pulley mechanism communicating with an engine output shaft, and a first pulley which is always in rotational unison with the engine output shaft and provides power to a transmission input shaft, and a second pulley which is selectively coupled in rotational unison with the engine output shaft and selectively provides power to an auger assembly.

SUMMARY

The invention generally provides snow blowers which exhibit improved efficiencies through, inter alia, a rotatable discharge chute, guided in rotation by at least one idler wheel communicating with such chute, the rotatable discharge chute being rotatably actuated by a cable assembly attached thereto, first and second ground-engaging wheels which are attached to each other through an open carrier differential mechanism, a selectable lock assembly which selectively locks the first and second drive wheels with each other, into rotational unison with each other, as desired by a user, a chain-driven auger, hydraulically adaptive speed control, and/or a transmission drive pulley and belt between the engine and an intervening clutch.

In a first family of embodiments, the invention comprehends a walk-behind snow blower apparatus, comprising: (a) a chassis; (b) an axle assembly communicating with the chassis; (c) a hydrostatic drive assembly drivingly communicating with the axle assembly; (d) a control handle, movement of the walk-behind snow blower apparatus being controlled by an operator through the handle; and (e) a user input device controllingly attached to the hydrostatic drive assembly, the walk-behind snow blower apparatus being movable in a first, forward direction of travel, or in a second, opposite and reverse direction of travel, at speeds which are continuously variable between a first relatively slower speed of travel and a second substantially faster speed of travel, and multiple intermediate speeds between the first and second speeds, the user input device and the hydrostatic drive assembly, in combination, being adapted and configured to adaptively control the walk-behind snow blower apparatus based on a user input applied to the user input device which continuously variably and adaptively influences and/or controls the real time speed of travel of the walk-behind snow blower apparatus.

In some embodiments, the user input device controls both direction of travel and the continuously variable speed of travel.

In some embodiments, the user input device is a handle which effects control movements by pivoting the handle about an axis of pivotation.

In some embodiments, when the handle is urged in a first direction, the walk-behind snow blower apparatus correspondingly travels in a such first direction and when the pivotably handle is urged in a second, opposite direction, the walk-behind snow blower apparatus correspondingly travels in a such second, opposite direction.

In some embodiments, the handle has a resting, neutral position, a maximum forward position, and a maximum reverse position, the handle being continuously variably movable between the maximum forward position and the maximum reverse position.

In some embodiments, the magnitude of the distance by which the handle is displaced from the resting, neutral position corresponds to the magnitude of the speed at which the walk-behind snow blower travels whereby pivotation of the handle a relatively greater distance from such resting, neutral position corresponds to a correspondingly greater rate of speed at which the walk-behind snow blower travels.

In a second family of embodiments, the invention comprehends a snow blower apparatus, comprising: (a) a running gear assembly which includes (i) a chassis; (ii) a first wheel assembly and a second wheel assembly; (iii) an axle assembly communicating with the chassis, the axle assembly extending between the first and second wheel assemblies and including a differential mechanism between the first and second wheel assemblies; and (b) an auger assembly communicating with the running gear assembly; the axle assembly having a first axle shaft having an inwardly facing end and a outwardly facing end, and a second axle shaft having an inwardly facing end and an outwardly facing end, the inwardly facing ends of the first and second axle shafts being proximate each other and each being coupled to the differential mechanism, whereby the first and second axle shafts are rotatable about a generally common axis of rotation and are always coupled to each other by way of the differential mechanism.

In some embodiments, the differential mechanism comprises a generally hollow differential case rotatable about an axis of rotation which is coaxial with the axis of rotation of the first and second axle shafts, each of the first ends of the first and second axle shafts having an axle inner-end gear affixed thereto, the axle inner-end gears being rotatable with respective ones of the first and second axle shafts and the axle inner-end gears being rotatably housed in the differential case.

In some embodiments, the axle inner-end gears are bevel gears and the differential mechanism further includes first and second spider gears which are rotatably housed in the differential case, each of the first and second spider gears being rotatable about an axis of rotation which is generally perpendicular to the axis of rotation of the differential case and the first and second axle shafts, each of the spider gears spanning between and rotatably connecting the axle inner-end gears to each other.

In some embodiments, the snow blower further comprising a ring gear mounted to the differential case, the ring gear and the differential case being generally locked in rotational unison whereby rotation of the ring rear corresponds to rotation of the differential case.

In some embodiments, the outwardly facing ends of the first and second axle shafts is connected to respective ones of the first and second wheel assemblies.

In some embodiments, the snow blower further comprising a selectable lock assembly adapted and configured to selectively lock the first and second wheel assemblies in rotational unison with respect to each other.

In a second family of embodiments, the invention comprehends a snow blower apparatus, comprising: (a) a chassis; (b) a first wheel assembly and a second wheel assembly; (c) an axle assembly communicating with the chassis, the axle assembly extending between the first and second wheel assemblies; and (d) a selectable lock assembly adapted and configured to selectively lock the first and second wheel assemblies in rotational unison with respect to each other, the selective lock assembly including a tie shaft which extends in a generally common direction with, and displaced from, the axle assembly.

In some embodiments, the snow blower further comprising an inner hub gear attached to one of the first and second wheel assemblies, the inner hub gear being selectively engageable with and disengageable from the tie shaft.

In some embodiments, the snow blower further comprising a first inner hub gear attached to the first wheel assembly, and a second inner hub gear attached to the second wheel assembly, at least one of the first and second inner hub hears being selectively engageable with the tie shaft, and disengageable from the tie shaft.

In some embodiments, the tie shaft includes a tie shaft gear mounted thereupon, the tie shaft gear being adapted and configured to cooperate with a respective one of the hub gears.

In some embodiments, the tie shaft includes a first tie shaft gear mounted thereon and a second tie shaft gear mounted thereon and the first and second tie shaft gears being adapted and configured to cooperate with and to selectively interface with, respective ones of the first and second hub gears.

In some embodiments, the tie shaft is movable between a first wheel locked position and a second wheel unlocked position, wherein when the tie shaft is in the wheel locked position, the first and second wheel assemblies are generally locked in rotational unison with respect to each other and when the tie shaft is in the wheel unlocked position, the first and second wheel assemblies are generally not locked in rotational unison with respect to each other.

In some embodiments, the tie shaft is pivotably movable between such wheel locked position and such wheel unlocked position.

In some embodiments, the tie shaft is resiliently pivotably movable between such wheel locked position and such wheel unlocked position.

In some embodiments, the tie shaft is resiliently pivotably movable between such wheel locked position and such wheel unlocked position and such selectable lock assembly further includes a biasing member which provides a resilient force generally resisting such pivotable movement of the tie shaft.

In some embodiments, the biasing member is a spring.

In some embodiments, the snow blower further comprising a foot-pedal operatively connected to the tie shaft, the foot-pedal being movable between a first position and a second position, whereby the foot-pedal in the first position corresponds to the tie shaft in the wheel unlocked position and the foot-pedal in the second position corresponds to the tie shaft in the wheel locked position.

In some embodiments, the snow blower further comprising a handle operatively coupled to the tie shaft and adapted and configured for hand manipulation by a user, the handle being movable between a first position and a second position, whereby the handle in the first position corresponds to the tie shaft in the wheel unlocked position and the handle in the second position corresponds to the tie shaft in the wheel locked position.

In some embodiments, the snow blower further comprising a lever assembly and a cable assembly, operatively connected to each other, the cable assembly actuatingly communicating with the tie shaft, and the lever assembly being adapted and configured for use by a hand of a user, the communicating actions of the lever to thereby cause locking and unlocking actions of the tie shaft.

In some embodiments, the axle assembly includes a first axle shaft and a second axle shaft, the first and second axle shafts being in generally coaxial alignment with each other.

In some embodiments, the tie shaft has a length dimension which is greater in magnitude than the magnitude of length dimensions of ones of the first and second axle shafts, collectively.

In some embodiments, the magnitude of the length dimension of the tie shaft corresponds generally to the sum of the length dimensions of the first and second axle shafts.

In a fourth family of embodiments, the invention comprehends a snow blower apparatus, comprising: (a) a running gear assembly which includes a prime mover; (b) an auger assembly communicating with the running gear assembly, the auger assembly including: (i) a chain driven auger, driven by a chain; and (ii) a shaft driven impeller, driven by a shaft; the auger and the impeller rotatable at first and second different angular rotational speeds, respectively; (c) a force transmission device having an input shaft and an output shaft, the input shaft and the output shaft extending in respective directions which are non-parallel to each other, the output shaft having a sprocket mounted thereupon; and the chain extending between and drivingly connecting the force transmission device and the auger assembly.

In some embodiments, the drive chain is driven by such shaft which drives the impeller.

In some embodiments, the force transmission device input shaft includes a sprocket mounted thereupon.

In some embodiments, the engine output shaft extends in a direction which is generally parallel to the direction in which the force transmission device input shaft extends.

In a fifth family of embodiments, the invention comprehends a snow blower apparatus, comprising: (a) a running gear assembly; (b) an auger assembly, including an auger housing which communicates with the running gear assembly; and (c) a discharge chute assembly, having a lower chute flange, and an idler wheel communicating therewith; the lower chute flange being rotatable about a first axis of rotation and the idler wheel being rotatable about a second axis of rotation, the first axis of rotation and the second axis of rotation extending generally parallel to each other, whereby the idler wheel generally guides rotating travel of the chute lower flange.

In some embodiments, the snow blower comprises first and second idler wheels, the chute lower flange extending generally between the first and second idler wheels, wherein the chute lower flange is adapted and configured to rollingly and/or slidingly communicate with ones of the first and second idler wheels.

In some embodiments, the chute flange generally defines an outer perimeter and the snow blower comprises a plurality of idler wheels, the plurality of idler wheels rollingly and/or slidingly communicating with the chute lower flange, the idler wheels being spaced generally equidistant from other respective ones of the idler wheels about the outer perimeter of the chute flange.

In some embodiments, the idler wheel defines an outer circumferential surface, a groove extending into the outer circumferential of the idler wheel and optionally about the entire circumference of the idler wheel.

In some embodiments, the chute lower flange defines a thickness dimension and the idler wheel includes an outer circumferential surface and a groove extending into the outer circumferential surface, the groove defining a groove opening width, and a groove depth, and wherein the magnitude of the groove width is greater than the magnitude of the chute lower flange thickness dimension.

In some embodiments, the idler wheel defines an outer circumferential surface, a groove extending into the outer circumferential of the idler wheel, a portion of the chute flange being housed in, optionally slidingly housed in, a corresponding portion of the groove which extends into the idler wheel outer circumferential surface.

In some embodiments, the idler wheel defines an outer circumferential surface and a groove extends into the outer circumferential of the idler wheel, the chute flange being received in the idler wheel groove, the idler wheel and the chute flange generally rollingly interfacing with each other.

In some embodiments, the idler wheel is made from polymeric material.

In a sixth family of embodiments, the invention comprehends a snow blower apparatus, comprising: (a) a running gear assembly; (b) an auger assembly, including an auger housing which communicates with the running gear assembly; (c) a discharge chute, having an outer wall, the discharge chute being rotatably connected to the auger housing; and (d) a control handle, movement of the snow blower apparatus being controlled by an operator through the control handle, the control handle having a proximal end proximate the running gear assembly and a remote end displaced from the running gear assembly; (e) a cable assembly attached to the discharge chute outer wall and having a first cable segment and a second cable segment; and (f) a cable receptacle and controller assembly mounted on the handle proximate the remote end of the handle, wherein when a force is applied in a first direction to the first cable segment, the discharge chute rotates in a first direction of chute rotational travel and when a force is applied in such first direction to the second cable segment, the discharge chute rotates in a second, opposite direction of chute rotational travel.

In some embodiments, the discharge chute defining an outer perimeter, wherein the first cable segment extends around the discharge chute outer perimeter in a first direction and the second cable segment extends around the discharge chute outer perimeter in a second, opposite direction.

In some embodiments, the snow blower apparatus further comprising a rotatable handle on the cable receptacle and controller assembly, the rotatable handle being rotatable in a first direction of handle rotational travel and in a second, opposite direction of handle rotational travel, thereby to rotate the cable receptacle and controller assembly, the first direction of handle rotational travel corresponding to the first direction of chute rotational travel and the second direction of handle rotational travel corresponding to the second direction of chute rotational travel.

In some embodiments, the cable receptacle and controller assembly comprising a generally cylindrical idler spool, the idler spool being adapted and configured to windingly store portions of the cable thereupon and to windingly release portions of the cable therefrom, upon rotation of the handle.

In a seventh family of embodiments, the invention comprehends a snow blower apparatus, comprising: (a) an engine having an output shaft; (b) a transmission; (c) a plurality of drive wheels drivingly connected to the transmission; and (d) an electromagnetic clutch and pulley assembly communicating with the engine output shaft and comprising (i) a first pulley connected to, and locked in rotational unison with, the engine output shaft and located relatively proximate the engine; (ii) a second pulley, located relatively distal from the engine, which selectively rotates with the engine output shaft; and (iii) an electromagnetic clutch connected to the engine output shaft and selectably coupled to the second pulley, the electromagnetic clutch being selectable between a first engaged condition and a second disengaged condition, the second pulley generally rotating with the engine output shaft when the electromagnetic clutch is in such engaged condition, and the second pulley generally not rotating with the engine output shaft when the electromagnetic clutch is in such disengaged condition.

In some embodiments, the transmission includes a transmission input shaft, the transmission input shaft and the engine output shaft being generally perpendicular to each other.

In some embodiments, a third pulley is mounted upon the transmission input shaft, the snow blower further comprising a belt connecting the second pulley and the third pulley to each other.

In some embodiments, a third pulley is mounted upon the transmission input shaft, the transmission input shaft and the engine output shaft being oriented generally perpendicular to each other, the snow blower further comprising a belt operatively extending between the second and third pulleys.

In some embodiments, a first idler wheel mounted between the second pulley and the third pulley and communicating with the belt.

In some embodiments, the snow blower further comprising a first idler wheel mounted between the second pulley and the third pulley and communicating with the belt, the second idler wheel having an outer circumferential surface, the belt, at any given time, extending along about 25% of the outer circumferential surface of the idler wheel.

In some embodiments, the belt defines about 90 degrees change in direction of the belt about the outer circumferential surface of the idler wheel.

In some embodiments, the electromagnetic clutch further comprises a brake, wherein when the electromagnetic clutch is in a disengaged condition, the brake is in an engaged condition.

In an eighth family of embodiments, the invention comprehends a snow blower apparatus, comprising: (a) an engine having an output shaft; (b) a transmission; and (c) a plurality of drive wheels drivingly connected to the transmission; and (d) a pulley assembly attached to the engine output shaft; the pulley assembly including a first pulley, a second pulley, and a belt mounted about the first pulley, the first pulley being fixedly secured to the engine output shaft and rotating in unison therewith, the belt being constantly tensioned, and thereby being constantly driven by the first pulley, the second pulley selectively rotating in unison with the engine output shaft.

In some embodiments, the second pulley is connected to a clutch mechanism, the clutch mechanism being attached to the engine output shaft whereby the second pulley clutchingly selectively rotates in unison with the engine output shaft.

In some embodiments, the clutch mechanism is an electromagnetic clutch.

In some embodiments, the belt also engages, and drives, first and second drive wheels which are constantly connected to each other and wherein the first and second drive wheels can be driven at first and second speeds at a given point in time.

Figure 1A:
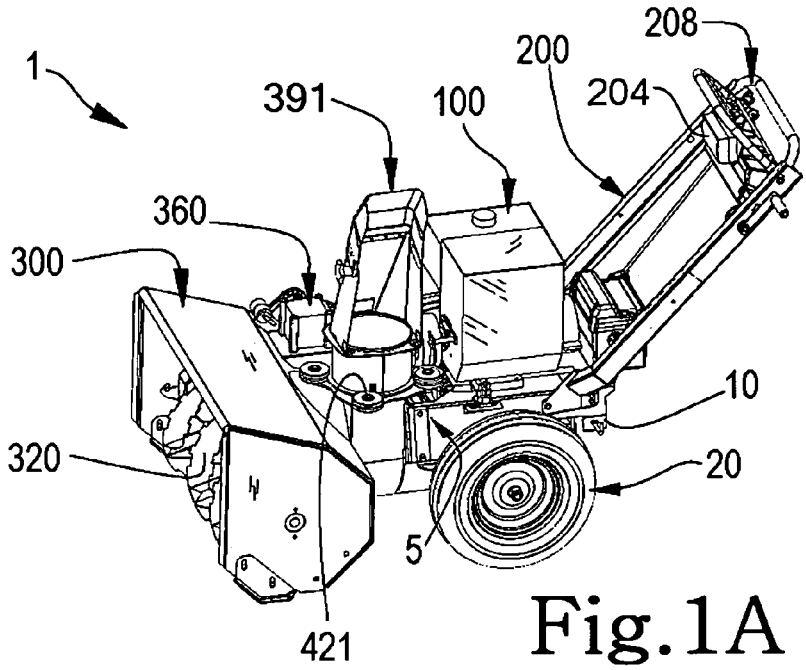
FIG. 1A shows a first pictorial view of snow blower apparatus of the invention.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Figure 1B:
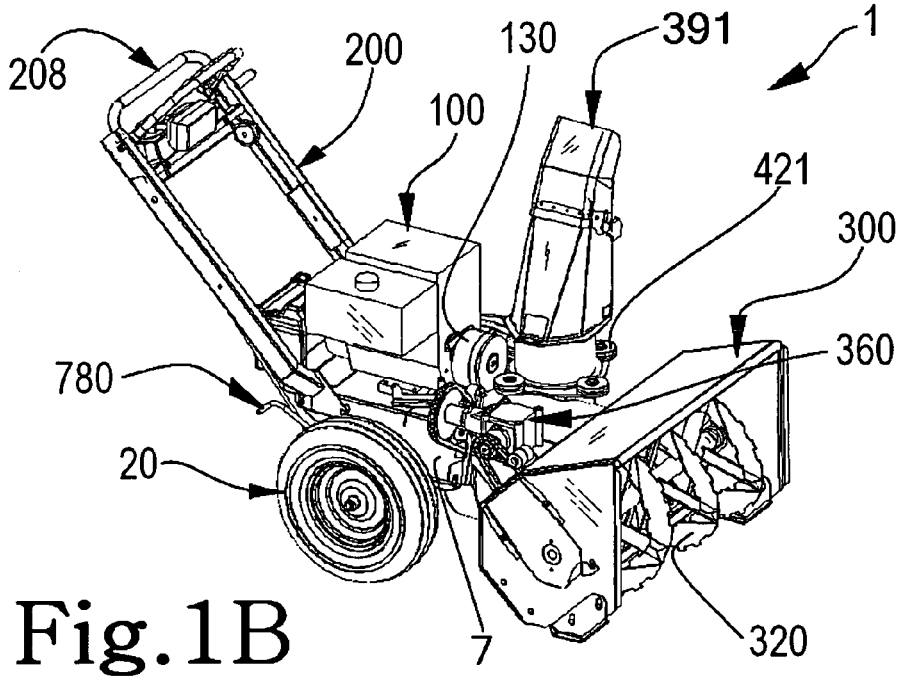
FIG. 1B shows a second pictorial view of the snow blower apparatus of FIG. 1A.

FIGS. 1A and 1B show different pictorial views of a first embodiment of snow blower apparatus 1 of the invention. In a typical implementation of the invention, a snow blower 1 includes running gear assembly 5, prime mover 100, handle assembly 200, auger assembly 300, and discharge chute assembly 391.

Although the exemplary embodiments illustrated herein illustrate snow blower 1 as being adapted and configured as a self-propelled, walk behind, apparatus, at least some of the novel and non-obvious features, components, combinations, subassemblies, assemblies, and methods, are equally applicable to other various snow removal devices and are well within the scope of the invention in such implementation. Such other various snow removal devices include, but are not limited to, those operably mounted to lawn tractors, skid-steer tractors, full-size tractors, all-terrain-vehicles, pickup trucks, full-size trucks, and/or others, and are well within the scope of the invention.

As will be described in greater detail hereinafter, running gear 5 is operatively attached, by way of, for example, power transmission assembly 60 (FIG. 2A), to prime mover 100, whereby prime mover 100 generally provides power to the snow-engaging elements of snow blower 1. Handle assembly 200 is attached to a first end portion of running gear assembly 5 and is adapted and configured to transmit user control input to the remainder of the assemblage of snow blower 1. Auger assembly 300 is attached to a second, opposite, end portion of running gear assembly 5, is adapted and configured to pull, drag, sweep, or otherwise draw and/or receive e.g. snow thereinto, and generally defines a first-stage of snow blower 1. Discharge chute assembly 391 is mounted generally between, and communicates with each of, running gear assembly 5 and auger assembly 300. The discharge chute assembly 391 is adapted and configured to remove snow from auger assembly 300 and/or to otherwise accept snow from the auger assembly and blow, throw, propel, and/or otherwise discharge such snow from the snow blower apparatus.

Figure 2A:
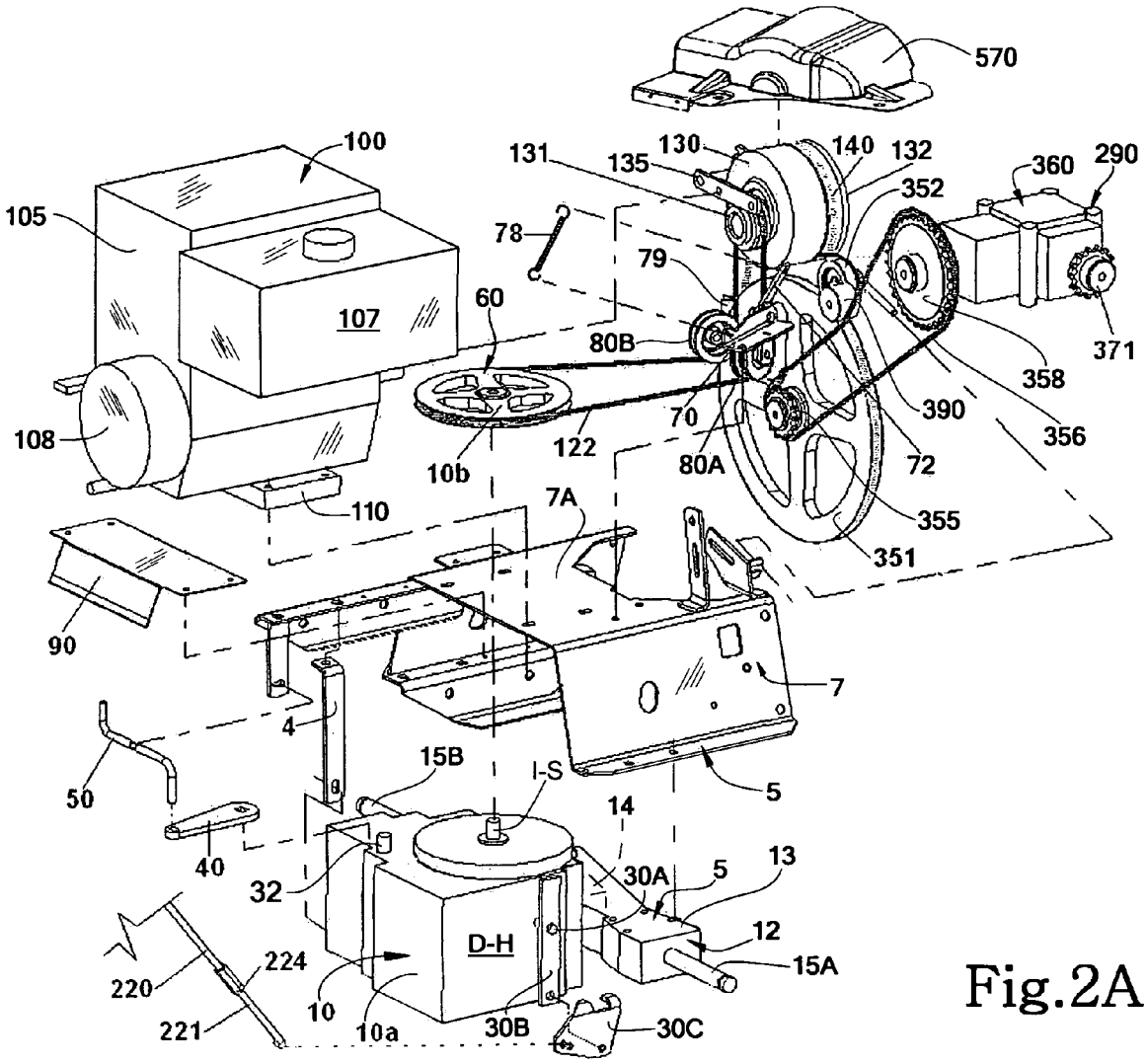
FIG. 2A shows an exploded, pictorial, view of parts of the running gear assembly and various adjacent parts of the snow blower apparatus of FIG. 1A.
Figure 3:
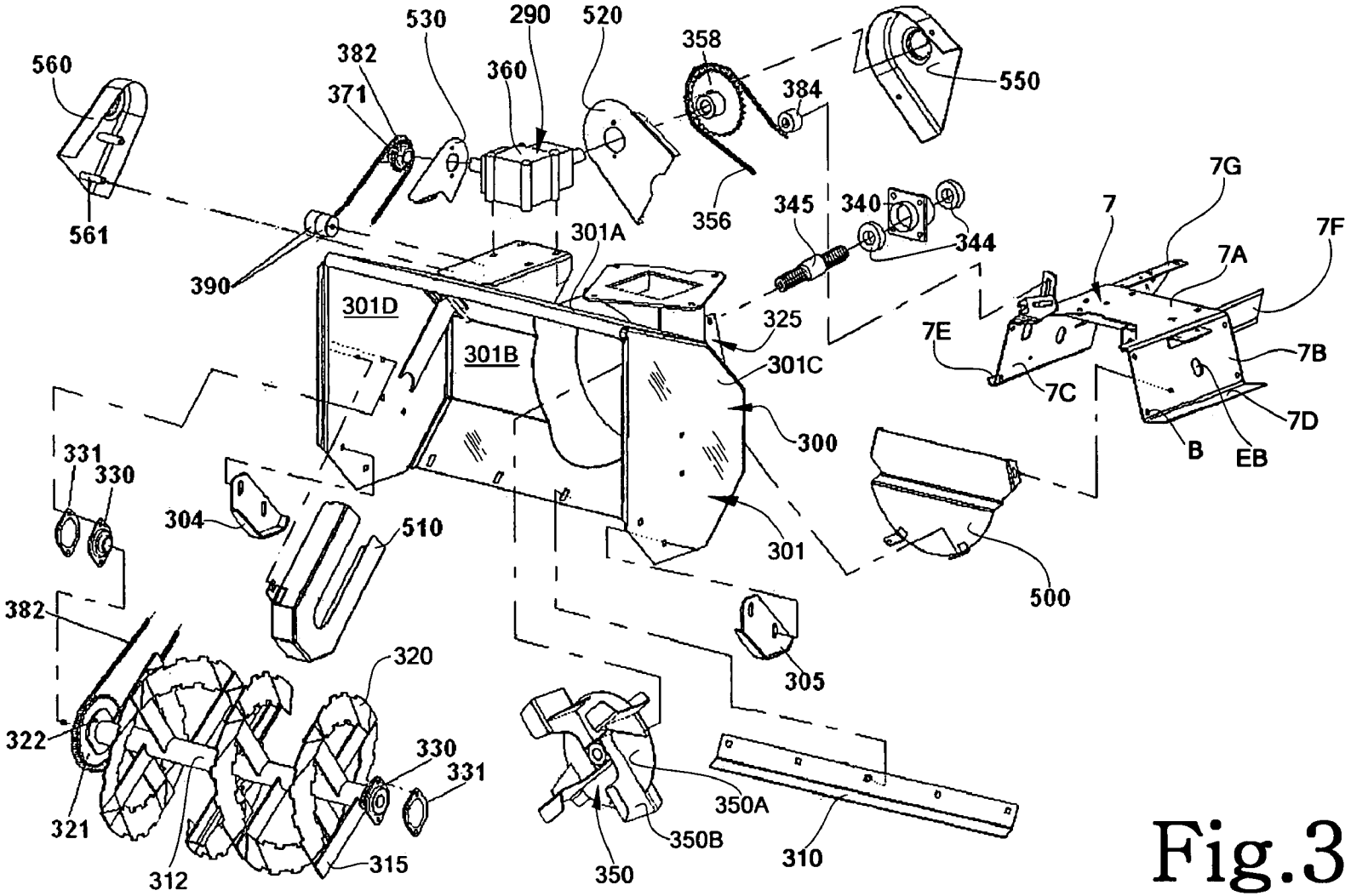
FIG. 3 shows an exploded, pictorial, view of the auger assembly and various adjacent parts of the snow blower apparatus of FIG. 1A.
Figure 6:
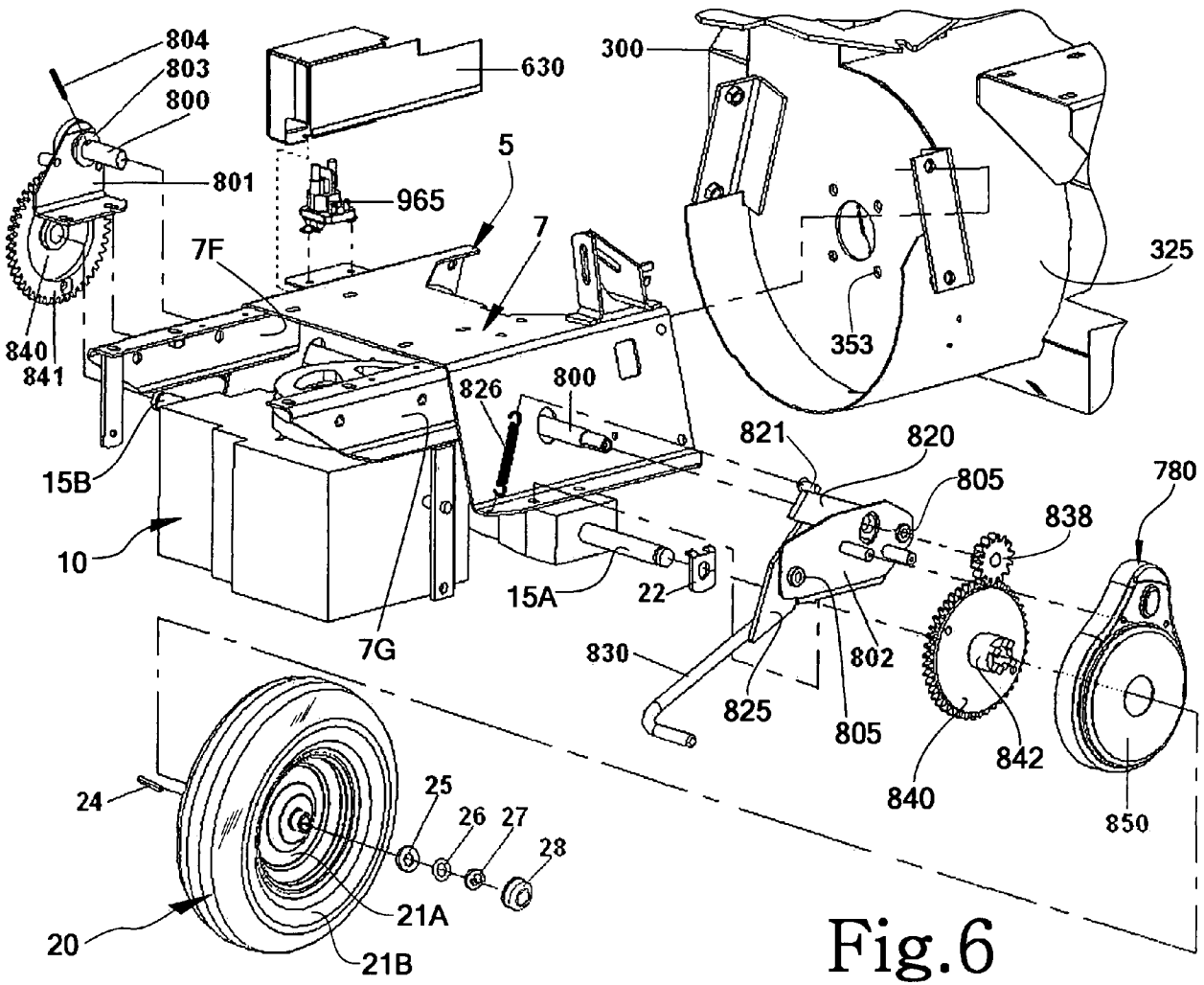
FIG. 6 shows an exploded, pictorial, view of parts of the running gear assembly and various adjacent parts, including a wheel assembly, of the snow blower apparatus of FIG. 1A.

Referring now to FIGS. 2A, 3 and 6, running gear assembly 5 includes chassis 7, transaxle assembly 10, and wheel assemblies 20. Chassis 7 includes chassis top-plate 7A, first and second chassis sidewalls 7B, 7C, chassis lower flanges 7D, 7E, and chassis frame rails 7F, 7G.

As desired, a plurality of bores "B" extend through various suitable portions and locations of chassis 7, e.g. through ones of chassis top-plate 7A, first and second chassis sidewalls 7B, 7C, and chassis lower flanges 7D, 7E. Chassis 7 generally defines the structure, e.g. support structure, frame structure, and/or mounting structure, upon which various other parts, components, subassemblies, and assemblies are mounted, by way of bores "B" or otherwise.

Chassis top-plate 7A is generally planar, has a length, and a width defined between two lateral edges. Each of the first and second chassis sidewalls 7B, 7C is a planar member which has an upper edge, a lower edge, and two lateral edges which define a width therebetween.

The upper edge of chassis sidewall 7B is connected to the first lateral edge of chassis top-plate 7A. Sidewall 7B extends generally angularly downwardly and outwardly, along a generally straight line path, from the point of intersection with top-plate 7A. In other words, chassis sidewall 7B slopes downwardly and outwardly from top-plate 7A. Elongate bore "EB" extends through the thickness of sidewall 7B, and has a bore length and a bore width. The bore length of elongate bore "EB" is greater in magnitude than the magnitude of the bore width, whereby elongate bore "EB" defines a slot which extends through sidewall 7B.

The upper edge of chassis sidewall 7C is connected to the second lateral edge of chassis top-plate 7A. Sidewall 7C extends generally angularly downwardly and outwardly, along a generally straight line path, from the point of intersection with top-plate 7A. In other words, chassis sidewall 7C slopes downwardly and outwardly from top-plate 7A, in generally the opposite direction from the direction of extension of sidewall 7B.

Like chassis sidewall 7B, an elongate bore "EB" extends through the thickness of sidewall 7C, and has a bore length and a bore width. The bore length of elongate bore "EB" is greater in magnitude than the magnitude of the bore width, whereby elongate bore "EB" defines a slot which extends through sidewall 7C. The elongate bores "EB" of the sidewalls 7B, 7C are generally in coaxial alignment with each other.

Each of the chassis lower flanges 7D, 7E is a planar member which has an inwardly facing edge, an outwardly facing edge, and two end edges. Lower flanges 7D and 7E are generally coplanar with each other and are generally parallel to chassis top-plate 7A. The inwardly facing edges of lower flanges 7D and 7E are connected to the lower edges of sidewall 7B and sidewall 7C, respectfully. Each lower flange 7D, 7E extends outwardly away from the respective chassis sidewall 7B, 7C, whereby the lower flanges 7D, 7E extend outwardly from the sidewalls in generally opposite directions.

Each of chassis frame rails 7F, 7G is an elongate, rigid member which is adapted and configured to hold, carry, and/or otherwise support various components of snow blower 1. In addition, frame rails 7F, 7G, are adapted and configured to offer, for example, relatively increased rigidity and/or strength to certain portions of the chassis 7.

As illustrated, each of frame rails 7F, 7G has a generally upright portion which defines a top and bottom thereof, and first and second transversely extending flanges and each is connected to the remainder of chassis 7 through, for example, chassis top-plate 7A. The first flange extends from the top of the upright portion, toward the other respective frame rail, and the second flange extends from the bottom of the upright portion, toward the other respective frame rail and generally parallel to the first flange, whereby each of the frame rails generally defines a channel configuration.

The first and second flanges of frame rails 7F, 7G extend along planes which are generally parallel to the plane defined by chassis top-plate 7A. In the complete assemblage of chassis 7, chassis top-plate 7A overlies and generally interfaces with a portion of the length of frame rails 7F, 7G Transaxle assembly 10 is operatively attached to and receives power from prime mover 100 and includes drive housing "D-H," hydrostatic drive assembly 10A, transaxle pulley 10B, and axle assembly 12. Transaxle assembly 10, alone and/or in combination with other various components, e.g. controls, of snow blower 1, is adapted and configured to enable a user to adaptively control the speed and/or direction of travel of snow blower 1.

Hydrostatic drive assembly 10A includes drive input shaft "I-S," at least one hydraulic pump, namely at least one variable displacement hydraulic pump, at least one hydraulic motor which can have a motor output shaft, a drive assembly output shaft which can include a pinion gear e.g. pinion gear "P" (FIG. 2B), optionally a sprocket and chain assembly, optionally other force suitable force transmitting devices, at the end thereof. Hydrostatic drive assembly 10A further includes various user control input devices, which include, but are not limited to, input control shaft 30A, input arm 30B, input bracket 30C, roll-release shaft 32, roll-release arm 40, roll-release lever 50, and/or others, as well as various pieces of suitable hydraulic plumbing e.g. various suitable tubes, hoses, pipes, fittings, valves, switches, hardware, housings, linkages, force transmission devices and/or others.

Drive housing "D-H" is a multiple walled enclosure structure which has, for example, a top wall, a bottom wall, and a front wall, a back wall, and first and second sidewalls. Ones of the various walls of drive housing "D-H" are connected to other respective ones of the walls, so that the entire assemblage is generally liquid tight, capable of suitably holding e.g. hydraulic fluid therein.

Also, drive housing "D-H" is adapted and configured to enclosingly house ones of, for example, the variable displacement hydraulic pump, the hydraulic motor, various pieces of suitable hydraulic plumbing e.g. various suitable tubes, hoses, pipes, fittings, valves, switches, hardware, housings, at least part of the drive input shaft "I-S," and/or other components of hydrostatic drive assembly 10A, therein. In other words, the interior space of drive housing "D-H" generally defines the operating environment of hydrostatic drive assembly 10A.

Hydrostatic drive assembly 10A realizes a continuously, e.g. infinitely, variable rotational speed output of the hydraulic motor output shaft, whereby the speed by which snow blower 1 moves along the ground is continuously, infinitely, e.g. without step changes in magnitude, variable between a minimum speed and a maximum speed, in each of a forward direction and an opposite, reverse direction.

Drive input shaft "I-S" is an elongate, rotatable, shaft which defines an outside diameter and is cooperatively coupled to the variable displacement hydraulic pump. Namely, input shaft "I-S" transmits the energy, e.g. the rotational energy, to the variable displacement hydraulic pump.

An end of input shaft "I-S" extends outwardly beyond the drive housing "D-H." Input shaft "I-S" rotatably interfaces with drive housing "D-H" by way of, for example, a seal assembly and/or a bearing assembly which enables the input shaft to rotate with respect to the drive housing while having a generally liquid tight seal between the shaft and housing.

The variable displacement hydraulic pump and the hydraulic motor, hydraulically communicate with each other. The variable displacement hydraulic pump is adapted and configured to drive the hydraulic motor which effectuates rotational movement of a motor output shaft which extends from the hydraulic motor.

In the entire assemblage of hydrostatic drive assembly 10A, the rotational energy of input shaft "I-S" is converted to fluid flow and thus fluid energy by way of the hydraulic pump, whereby the pump transmits the fluid to the hydraulic motor. The hydraulic motor receives the fluid flow, and converts the fluid flow energy back to rotational energy and motion.

In use of snow blower 1, a user controls, as desired, the volume and velocity of hydraulic fluid which flows from the variable displacement hydraulic pump to and/or from the hydraulic motor, and the direction of rotational travel of the hydraulic motor. In other words, a user of snow blower 1, as desired, adaptively controls the speed and/or direction of travel of snow blower 1. The user at least partially controls the direction and speed output of the hydraulic motor by way of input control shaft 30A, input arm 30B, and input bracket 30C.

Input control shaft 30A is pivotable, about an axis of pivotation, in first and second directions of pivotation. The control shaft 30A operably communicates with ones of the components of hydrostatic drive assembly 10A, whereby the direction of pivotation and magnitude of pivotal travel correspond to direction and magnitude of rotational speed output of the hydraulic motor and thus the direction and magnitude of movement of snow blower 1 along the ground.

Input arm 30B is an elongate, rigid, member which has a bore extending through the thickness thereof. The bore of input arm 30B concentrically accepts the end of input control shaft 30A therein. And the shaft 30A and input arm 30B are fixedly attached to each other, by way of e.g. cooperating splines, keys and keyways, aligned bores and insertable pins, press fit, friction fit, weldments, and/or others.

Accordingly, input arm 30B pivots about an axis of pivotation common to that of control shaft 30A. Since the shaft 30A and arm 30B are fixedly attached to each other, pivotal movement of arm 30B causes a corresponding pivotal movement of shaft 30A, and thus a corresponding output of the hydrostatic drive assembly 10A.

Input bracket 30C is adapted and configured to enable various control devices, remote from the hydrostatic drive assembly 10A, to be operably coupled to input arm 30B and thus input control shaft 30A. Input bracket 30C is generally planar and has various bores extending through the thickness thereof which are adapted and configured to suitably receive and/or house various components of e.g. user input devices therein. As desired, input bracket 30C includes, for example, first and second tabs which extend generally perpendicularly from the remainder of the bracket, toward the hydrostatic drive assembly 10A. Each tab communicates with a respective lateral side surface of input arm 30B which generally increases the ability of input bracket 30C to transmit a force applied thereto to the input arm 30B.

Roll-release shaft 32 extends outwardly from the top wall of drive housing "D-H" and is pivotably movable between a first and second position. Roll-release shaft 32 is adapted and configured to e.g. release axle shafts 15A, 15B, from ones of the other components of transaxle assembly 10 and/or to otherwise enable wheel assemblies 20 to freewheel with respect to transaxle assembly 10. Namely, when roll-release shaft 32 is in the first position, wheel assemblies 20 generally freely rotate with respect to ones of the components of transaxle assembly 10 and when roll-release shaft 32 is in the second position the wheel assemblies do not generally freely rotate with respect to ones of the components of transaxle assembly 10.

Roll-release arm 40 is a generally elongate, planar bracket with a first, relatively wider end, and a second, relatively less wide, end. Each of the first and second ends of roll-release arm 40 has a bore which extends through the thickness thereof. The bore of the first roll-release arm end is adapted and configured to, at least in part, fixedly attach roll-release arm 40 to roll-release shaft 32. Namely, roll-release shaft 32 and roll-release arm 40 are attached to each other by way of, for example, keys and corresponding keyways, corresponding splines, setscrews, and/or otherwise. Thus, roll-release arm 40 pivots about a common axis, and in unison, with roll-release shaft 32.

The bore of the second end of roll-release arm 40 is adapted and configured to pivotably house part of roll-release lever 50 therein. Roll-release lever 50 is an e.g. S-shaped rigid member with first and second ends, and extends through, for example, an aperture in a locating bracket which generally positionally locates the lever with respect to transaxle assembly 10. The first end of roll-release lever 50 is pivotably housed in the bore of the second roll-release arm end, whereby a force imparted to roll-release lever 50 is transferred therethrough, upon roll-release arm 40, and thus to roll-release shaft 32.

The second end of roll-release lever 50 is adapted and configured for manipulation by a user. In other words, a user can, for example, grasp the second end of roll-release lever 50 and push and/or pull the lever, which pivots roll-release arm 40 and roll-release shaft 32 so as to either release or unrelease wheel assemblies 20 from ones of the components of transaxle assembly 10, as desired.

In some embodiments, a medial portion of roll-release lever 50 has an annular groove which extends around the circumferential surface thereof. The annular groove is adapted and configured to interface with portions of locating bracket, whereby the mechanical interfacing of the locating bracket and the annular groove generally positionally secures roll-release lever 50 with respect to transaxle 10.

Transaxle pulley 10B is adapted and configured to transmit rotational energy from e.g. prime mover 100 by way of, for example power transmission assembly 60, to input shaft "I-S" of transaxle assembly 10. Pulley 10B defines an outside diameter, an inside diameter, and an outer circumferential surface. The inside diameter of pulley 10B corresponds to the outside diameter of the drive input shaft "I-S" and pulley 10B is mounted, in rotational unison, to the drive input shaft. Accordingly, as pulley 10B rotates, input shaft "I-S" correspondingly rotates.

The outside diameter of pulley 10B is selected so that pulley 10B, alone and/or in combination with other components of snow blower 1, provides the desired rotational speed reduction, optionally desired rotational speed increase, between e.g. the output shaft of prime mover 100 and drive input shaft "I-S."

The outer circumferential surface of pulley 10B is adapted and configured to suitably interface with a means of transmitting and/or otherwise conveying power from e.g. prime mover 100 to input shaft "I-S" such as belts and/or other continuous bands of material adapted and configured to transmit power.

Figure 2B:
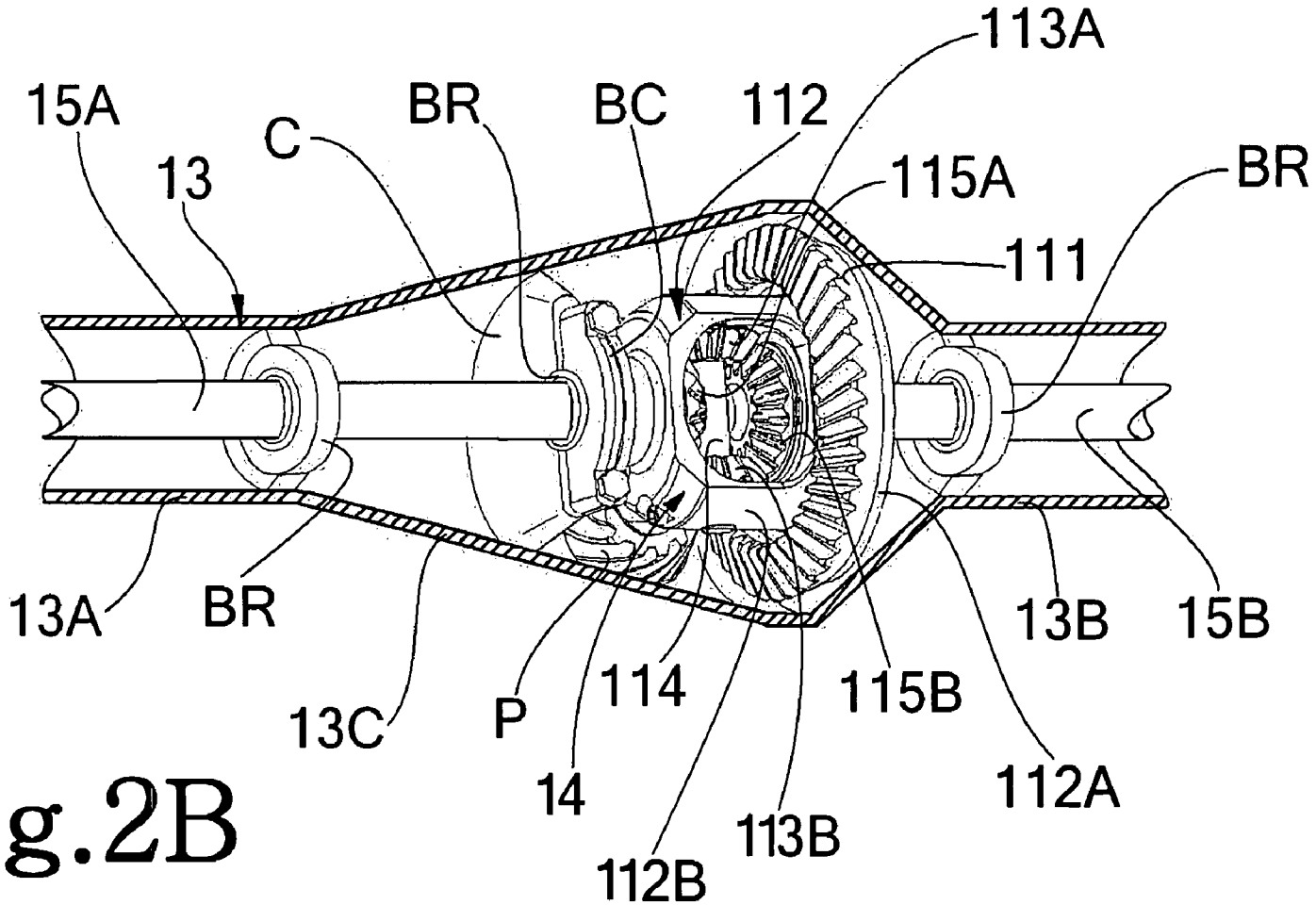
FIG. 2B shows a cut-away view of portions of the differential assembly.

Referring now to FIGS. 2A, and 2B, axle assembly 12 communicates with and/or is attached to hydrostatic drive assembly 10A. Optionally, as desired, axle assembly 12 and hydrostatic drive assembly 10A are integral and generally define a unitary body of transaxle assembly 10.

Axle assembly 12 includes axle housing 13, differential mechanism assembly 14, and first and second axle shafts 15A, 15B. Axle housing 13 is connected to the front wall of drive housing D-H and generally envelopes and encloses differential mechanism assembly 14 and parts of axle shafts 15A, 15B. In embodiments in which the hydrostatic drive assembly 10A and axle assembly 12 are integral, drive housing "D-H" and axle housing 13 are correspondingly also integral, whereby drive housing "D-H" can be generally devoid of a front wall and the front-most portion of transaxle assembly 10 is generally defined by the front-most portion of axle housing 13.

Referring now to FIG. 2B, axle housing 13 includes first and second lateral portions 13A, 13B, and medial portion 13C. First portion 13A is elongate, has an outer circumferential wall which has an inner surface and an outer surface. The inner surface of the outer circumferential wall generally defines an outermost perimeter of a generally cylindrical cavity which extends axially through the first portion 13A.

Axle housing first lateral portion 13A generally concentrically houses first axle shaft 15A therein, whereby axle shaft 15A is generally free to rotate with respect to first lateral portion 13A, defining an axis of rotation. Specifically, axle shaft 15A is rotatably housed in a bearing e.g. bearing "BR" which is in turn housed, by way of press-fit or otherwise, concentrically within first lateral portion 13A.

The number of bearings "BR" used and the spacing distance, for example, between respective bearings "BR" along the length of first lateral portion 13A, as well as the particular bearing design, size, and/or other characteristics, correspond at least in part to the particular intended use environment and expected loads of snow blower 1. As one example, as desired, first lateral portion 13A includes a bearing "BR" adjacent each end thereof, which provides radial and rotational support to axle shaft 15A at least two distinct locations along its length.

The axle housing second lateral portion 13B is elongate, has an outer circumferential wall which has an inner surface and an outer surface. The inner surface of the outer circumferential wall generally defines an outermost perimeter of a cylindrical cavity which extends axially through second lateral portion 13B.

Second lateral portion 13B generally concentrically houses second axle shaft 15B therein, whereby axle shaft 15B is generally free to rotate with respect to the housing second lateral portion 13B, defining an axis of rotation. Namely, axle shaft 15B is rotatably housed in a bearing e.g. bearing "BR" which is in turn housed, by way of press-fit or otherwise, concentrically within second lateral portion 13B.

Like first lateral portion 13A, the number of bearings "BR" used and the spacing distance between respective bearings "BR," along the length of second lateral portion 13B, as well as the particular bearing design, size, and/or other characteristics correspond, at least in part, to the particular intended use environment and expected loads of snow blower 1. As one example, second lateral portion 13B can include a bearing "BR adjacent each end thereof, which provides radial and rotational support to axle shaft 15B adjacent the first and second ends of second lateral portion 13B.

Axle housing medial portion 13C extends between and connects the inwardly facing ends of first and second lateral portions 13A, 13B. Medial portion 13C has first and second ends which define a length therebetween, and a cavity generally defined there within. The cavity within medial portion 13C generally encapsulates and houses differential mechanism assembly 14, and at least portions of axle shafts 15A, 15B.

As desired, medial portion 13C includes suitable bearing mounting structure to mount ones of bearings "BR" adjacent the ends of axle shaft 15A and/or axle shaft 15B. Such suitable bearing mounting structure includes, but is not limited to, e.g. a cast web such as casting "C" and a corresponding bearing retaining member such as bearing cap "BC." Bearing cap "BC" is adapted and configured to clampingly secure bearing "BR" against casting "C," whereby to generally locationally fix the bearing within the cavity of medial portion 13C.

Each of the first and second ends of medial portion 13C has a relatively lesser diameter as compared to the remainder of medial portion 13C. Thus, medial portion 13C defines a greatest diameter portion thereof, between the first and second ends, whereby from the first end, along the length of medial portion 13C, the medial portion radially increases toward the greatest diameter portion thereof, then, from the greatest diameter portion thereof, radially decreases toward the second end of medial portion 13C.

Differential mechanism assembly 14 includes ring gear 111, differential case 112, spider gears 113A, 113B, spider gear shaft 114, and axle inner end gears 115A, 115B. The differential mechanism assembly 14 connects axle shafts 15A, 15B, to each other and enables the axle shafts to rotate in a common direction at generally the same speed, in a common direction at generally different speeds, in opposite directions at generally the same speed, or in opposite directions at generally different speeds, while still attached to each other through the differential mechanism assembly.

Ring gear 111 is a generally annular bevel gear, optionally a spiral-cut bevel gear, optionally other suitable configurations. Ring gear 111 has a toothed e.g. front surface facing a first direction and a generally planar e.g. back surface facing a second, opposite direction. Ring gear 111 is adapted and configured to transmit torque provided by hydrostatic drive assembly 10A, alone or in combination with other components, from hydrostatic drive assembly 10A into rotational motion of the differential mechanism assembly 14 and correspondingly to the axle shafts 15A, 15B.

Namely, ring gear 111 is adapted and configured to operatively interface with and be rotated by pinion gear "P" which extends from the hydrostatic drive assembly 10A. In other words, pinion gear "P" and ring gear 111 are generally perpendicular to each other and generally define an interfacing gear-mesh relationship therebetween.

Differential case 112 includes a generally circular plate e.g. case back-plate 112A, a circumferential outer wall e.g. case outer wall 112B, and a top wall. The surface of case back-plate 112A which faces the remainder of differential case 112 interfaces with the generally planar e.g. back surface of ring gear 111.

Ring gear 111 and differential case 112 are connected to each other, and thus in rotational unison with each other, by way of, for example, but not limited to, corresponding bores and threaded bores in the case back-plate and ring gear, respectively, and suitable hardware. As one example, bores extend through case back-plate 112A and threaded bores extend into the generally planar back surface of ring gear 111. Bores of the back-plate 112A are coaxially aligned with corresponding threaded bores of the ring gear and suitable bolts extend therethrough, whereby ring gear 111 is threadedly secured to case back-plate 112A Case outer wall 112B extends generally axially outwardly from the case back-plate 112A. The inwardly facing surface of outer wall 112B generally defines an outer perimeter of a cavity within differential case 112. The cavity within differential case 112 houses Spider gears 113A, 113B, spider gear shaft 114, and axle inner end gears 115A, 115B.

As desired, outer wall 112B includes at least one opening extending therethrough, into the case cavity. First and second bores extend through outer wall 112B and into the case cavity. These first and second bores are generally coaxially aligned with each other. Also, the top wall of differential case 112 and case back-plate 112A each has a bore which extends axially and medially therethrough. The bores of the top wall and back-plate 112A are coaxially aligned with each other and are adapted and configured to accept the end of axle shaft 15A and the end of axle shaft 15B therethrough, respectively.

Each of spider gears 113A, 113B is a bevel gear, optionally a spiral-cut bevel gear, optionally other suitable configurations, which communicates with case outer wall 112B and has a bore which extends axially and medially therethrough. The spider gears 113A, 113B generally face each other and are rotatably mounted to generally opposite portions of case outer wall 112B, whereby the toothed surfaces of the gears generally face inwardly into the cavity of differential case 112.

Spider gear shaft 114 is an elongate, columnar, rod or pin which extends between the first and second spider gears 113A, 113B. Namely, first and second ends of shaft 114 extend through the bores of spider gears 113A and 113B, respectively. Thus, the first end of shaft 114 extends outwardly beyond spider gear 113A and into one of the bores which extends through differential case sidewall 112B. The second end of shaft 114 extends outwardly beyond spider gear 113B and into the other one of the bores which extends through differential case sidewall 112B.

The spider gears 113A, 113B are rotatably mounted to spider gear shaft 114. In particular, spider gears 113A, 113B are independently rotatably mounted to spider gear shaft 114, whereby the spider gears can rotatably travel in generally the same direction or in generally opposite directions with respect to each other.

Axle inner end gear 115A is a bevel gear, optionally a spiral-cut bevel gear, optionally other suitable configurations, which communicates with the differential case top wall and has a bore which extends axially and medially therethrough. End gear 115A rotates about and axis of rotation which is generally perpendicular to spider gear shaft 114 and thus to spider gears 113A, 113B.

The bore of end gear 115A defines a splined inner circumferential surface which is adapted and configured to slidingly insert onto a correspondingly splined outer circumferential surface of the inwardly facing end of axle shaft 15A. Thus, when end gear 115A is mounted to axle shaft 15A, the axle shaft 15A and end gear 115A are connected in rotational unison which each other.

The toothed surface of axle inner end gear 115A is adapted and configured to cooperate with the toothed surfaces of spider gear 113A and spider gear 113B, simultaneously. In other words, end gear 115A and the spider gears 113A, 113B generally define an interfacing gear-mesh relationship therebetween.

Like axle inner end gear 115A, axle inner end gear 115B is also a bevel gear, optionally a spiral-cut bevel gear, optionally other suitable configurations. End gear 115B communicates with the differential case back-plate 112A and has a bore which extends axially and medially therethrough. End gear 115B rotates about an axis of rotation which is generally perpendicular to spider gear shaft 114 and thus spider gears 113A, 113B.

The bore of end gear 115B defines a splined inner circumferential surface which is adapted and configured to slidingly insert onto a correspondingly splined outer circumferential surface of the inwardly facing end of axle shaft 15B. Thus, when end gear 115B is mounted to axle shaft 15B, the axle shaft 15B and end gear 115B are connected in rotational unison which each other.

The toothed surface of axle inner end gear 115B is adapted and configured to cooperate with the toothed surfaces of spider gear 113A and spider gear 113B, simultaneously. In other words, end gear 115B and the spider gears 113A, 113B generally define an interfacing gear-mesh relationship therebetween.

In use, pinion gear "P" rotatably drives ring gear 111. As ring gear 111 rotates, correspondingly so does differential case 112. In other embodiments, such as embodiments which use a chain or other force transmission device to rotate the differential case, the chain or other device operably interfaces with and rotatably drives the differential case 112.

The rotating differential case 112 ultimately rotates axle end gears 115A, 115B, by way of spider gears 113A, 113B. When spider gears 113A, 113B rotate along a first axis of rotation dictated by the rotation of differential case 112, yet do not rotate upon spider gear shaft 114, the spider gears 113A, 113B collectively rotate the axle end gears 115A, 115B and thus axle shafts 15A, 15B at generally the same speed and in the same direction.

By contrast, when spider gears 113A, 113B rotate upon spider gear shaft 114 and thus about an axis of rotation generally defined by the spider gear shaft, in addition to and/or in lieu of the rotation dictated by the rotation of differential case 112, the spider gears 113A, 113B generally, rotatably, and gear-meshingly e.g. advance and/or regress with respect to respective ones of axle end gears 115A, 115B, whereby the axle end gears and correspondingly axle shafts 15A, 15B rotates at, for example, generally different rotational speeds with respect to each other.

The particular manner, e.g. magnitude of speed and direction, in which ones of the differential case 112, spiders gears 113A, 113B, and/or axle end gears 115A, 115B rotate with respect to each other, corresponds to direction and speed of rotational travel realized at each of axle shaft 15A and axle shaft 15B. In other words, differential mechanism assembly 14 enables the axle shafts 15A, 15B, to rotate in a common direction at generally the same speed, in a common direction at generally different speeds, in opposite directions at generally the same speed, or in opposite directions at generally different speeds, while still attached to each other through the differential mechanism assembly.

Referring now to FIG. 2A, prime mover 100 includes internal combustion engine 105, fuel tank 107, starting mechanism 108, and mounting plate 110. Internal combustion engine 105 can be any suitable internal combustion engine as desired, including but not limited to, various 4-stroke engines, 2-stroke engines, gasoline powered engines, diesel powered engines, and/or others. In addition, the particular internal combustion engines 105 utilized include corresponding suitable fuel delivery systems to provide fuel/air mixtures to the internal combustion engine. Such suitable fuel delivery systems include, but are not limited to, carburetor based fuel delivery systems, fuel injection based fuel delivery systems e.g. throttle body injection systems, multi-port injection systems, direct injection systems, and/or others.

Fuel tank 107 is a generally enclosed, liquid tight, cell adapted and configured to hold fuel for use by the internal combustion engine 105. Namely, fuel tank 107 is plumbed to, or otherwise operably connected to, for example, the fuel delivery system of internal combustion engine 105.

Starting mechanism 108 communicates with internal combustion engine 105 and is adapted and configured to enable a user to start the engine. Starting mechanism 108 includes, but in not limited to, one or more of various suitable starting devices such as starting rope devices, electric motor starting devices, and/or others. Preferably, starting mechanism 108 includes a 12 Volt Direct Current electric starting motor which utilizes an on-board 12 Volt Direct Current battery e.g. battery 966 (FIG. 4) and further includes e.g. a rope-or cable based recoil, manual start backup mechanism.

Figure 4:
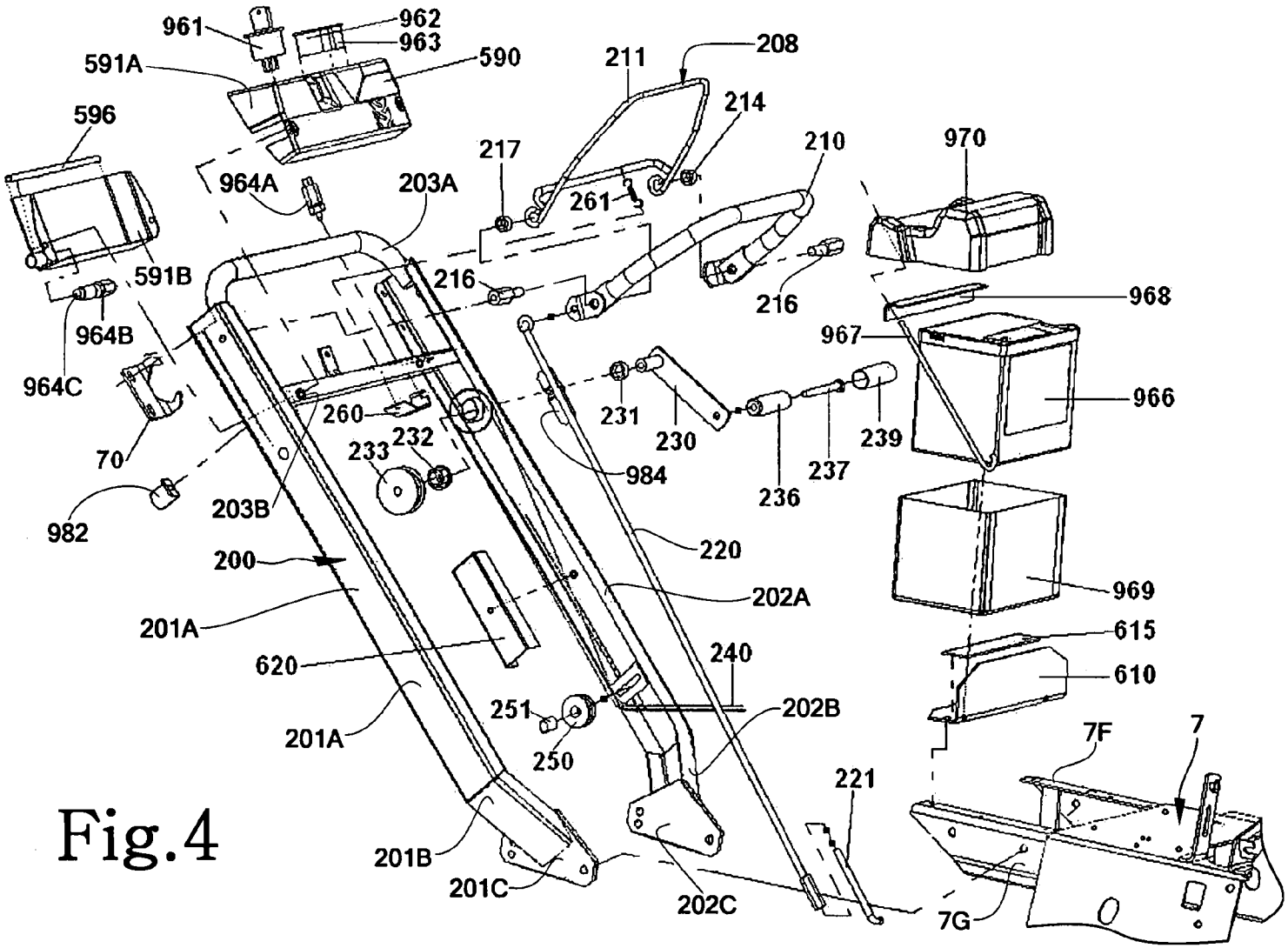
FIG. 4 shows an exploded, pictorial, view of the handle assembly and various adjacent parts of the snow blower apparatus of FIG. 1A.

Battery 966 is generally housed within an enclosure structure defined at least in part by battery tray 610, battery box 969, battery cover 970, and/or others. Battery tray 610 extends between frame rails 7F and 7G (FIG. 4). Cushion 615 lies between and provides at least some shock absorption between battery tray 610 and part of the bottom surface of battery 966.

Battery box 969 generally covers e.g. the side surfaces of battery 966. The battery is restrained in the enclosure structure by way of e.g. threaded draw rod 967 which is connected at a first end to battery tray 610 and which clampingly draws upper bracket 968 angularly downwardly against an upper edge of battery 966. Battery cover 970 generally overlies battery 966 and a major portion of upper bracket 968 and generally defines the uppermost portion of the battery enclosure structure.

Starting mechanism 108 further includes ignition switch 961 (FIG. 4) and a remotely located starter solenoid, namely solenoid 965 (FIG. 6), as part of a suitable starter switching and activating assembly. Optionally, solenoid 965 is not remotely located from starting mechanism 108, rather is integrally housed in the starter motor housing.

Mounting plate 110 is connected to a portion of internal combustion engine 105, e.g. the bottom surface of internal combustion engine 105. The mounting plate 110 is adapted and configured to mountingly interface with, for example, the upper surface of chassis top-plate 7A. Mounting plate 110 and thus prime mover 100 is attached to chassis top plate 7A and thus to chassis 7 by various suitable methods of attachment and/or joinder. Such suitable methods include, but are not limited to, e.g. hardware such as bolt, nuts, screws, rivets, and/or others.

An exemplary suitable prime mover 100 is available under the trade name SNOW KING ENGINE available from Tecumseh Products Company of Tecumseh, Michigan.

Power transmission assembly 60 includes bracket 70, idler support member 72, spring 78, idler support bracket 79, idlers 80A, 80B, belt 122, electromagnetic clutch 130, input pulley 131, clutched pulley 132, pulley brake 135, and belt 140. The power transmission assembly is adapted and configured to transmit power generated by the internal combustion to various other components of snow blower 1, namely transaxle assembly 10 and auger assembly 300.

Bracket 70 is e.g. a piece of angle-iron or other suitable stock which is adapted and configured to pivotably support idler support member 72. A first portion of bracket 70 is generally parallel to the ground and is attached to the upper surface of chassis top plate 7A, distal prime mover 100. The second portion of bracket 70 extends generally perpendicularly upwardly from the first bracket portion.

A bore extends through the thickness of the second portion of the bracket, for example horizontally, adjacent a first end of bracket 70. The horizontally extending bore of the first end of bracket 70 houses a pin upon which idler support member 72 is pivotally attached.

The second end of bracket 70, namely the end which is proximate prime mover 100, includes an upwardly extending tab, which extends upwardly from the remainder of the second, upright, portion of the bracket. The tab includes a bore which extends through the thickness thereof. The tab bore is adapted and configured to securingly accept an end of spring 78 therethrough.

Idler support member 72 has first and second ends and defines a length therebetween. A bore extends through thickness of idler support member 72, adjacent the first end thereof. The bore of the idler support member first end is adapted and configured to securingly accept an end of spring 78 therethrough.

A cylindrical shaft extends generally perpendicularly outwardly from the second end of idler support member 72. The cylindrical shaft functions as the axle shaft upon which idler 80A is mounted and rotates.

An aperture extends through the thickness of idler support member 72, at a medial portion thereof. The medial portion aperture concentrically accepts, or otherwise is attached to, the pin which extends from bracket 70, which enables idler support member 72 to generally pivot about an axis of pivotation defined by the bracket pin.

Spring 78 is a tension spring with first and second arcuate ends. The first arcuate end of spring 78 hookingly inserts through the tab bore of the second end of bracket 70, whereby the first end of spring 78 is attached to bracket 70. The second arcuate end of spring 78 hookingly inserts through the bore of the first end of idler support member 72, whereby the second end of spring 78 is attached to idler support member 72.

Since spring 78 is a tension spring, it tends to urge the first end of idler support member 72 toward the second end of bracket 70 and thus prime mover 100. Correspondingly, idler support member 72 tends to urgingly pivot about the bracket pin, which arcingly and pivotably moves the second end of idler support member 72, and the cylindrical shaft extending therefrom, generally away from prime mover 100.

Spring 78 is selected so that its length, spring rate, and/or other qualities are suitable for the intended use, so as to provide the desired magnitude of biasingly resilient force upon the pivotable idler support member 72.

Idler support bracket 79 is e.g. a piece of angle-iron or other suitable stock which is adapted and configured to rotatably support an idler wheel, namely idler 80B therein. A first portion of idler support bracket 79 is generally parallel to the ground and is attached to the lower surface of chassis top plate 7A, distal prime mover 100. The second portion of idler support bracket 79 extends generally perpendicularly downwardly from the first bracket portion, thus the second portion is generally upright.

A cylindrical shaft extends generally perpendicularly outwardly from the second, generally upright, portion of idler support bracket 79. The cylindrical shaft functions as the axle shaft upon which idler 80B is mounted and rotates.

Idlers 80A, 80B are adapted and configured to guide and support, for example, belt 122 and thus to help transmit rotational energy from e.g. prime mover 100 to input shaft "I-S" of transaxle assembly 10. Namely idlers 80A, 80B are adapted and configured to generally perpendicularly change the direction of travel of belt 122, whereby belt 122 extends generally vertically upwardly from idlers 80A, 80B and extends generally horizontally toward handle 200 from idlers 80A, 80B. In other words, idlers 80A, 80B enable a single belt to realize both rotational travel along a generally vertical plane and rotational travel about a generally horizontal plane, generally perpendicular thereto.

Each of idlers 80A, 80B defines an outside diameter, an inside diameter, and an outer circumferential surface. The inside diameter of ones of idlers 80A, 80B correspond to the outside diameter of corresponding ones of the cylindrical shafts of idler support member 72 and idler support bracket 79. In other words, idlers 80A and 80B are rotatably mounted to idler support member 72 and idler support bracket 79, respectively.

The outside diameters of idlers 80A, 80B are selected so that the idlers suitably change the direction of rotational advance of belt 122 while generally mitigating undesirable stresses imposed upon the belt, associated with such change in direction of advance.

Belt 122 has a cross-sectional profile, and/or other dimensional characteristics, which enable it to suitably rotate about pulleys and/or idlers, and change directions and/or planes of rotational travel about e.g. idlers 80A, 80B. Belt 122 can be any of a variety of suitable belts and/or other continuous bands of material adapted and configured to transmit power. Such suitable belts include, but are not limited to, various belts e.g. polyurethane based belts, neoprene based belts, Kevlar based belts and Kevlar reinforced belts, polyester based belts, rubber based belts, steel reinforced belts, cable reinforced belts, cordedly reinforced belts, and/or others.

Electromagnetic clutch 130 includes an electromagnetic clutch mechanism, input pulley 131, clutched pulley 132, and pulley brake 135. Electromagnetic clutch 130 is electrically selectable, by a user, between an engaged condition and a disengaged condition, whereby the user selects whether or not force is transmitted through the clutch. In other words, electromagnetic clutch 130, alone and/or in combination with other components of snow blower 1, functions as a power take off (PTO) device. The PTO enables the user to selectively transmit power to various components, such as auger assembly 300.

Input pulley 131 is attached to, and locked into rotational unison with, the output shaft of prime mover 100 and has an outer circumferential surface with is adapted and configured to drivingly interface with belt 122.

Preferably, the prime mover output shaft and input pulley 131 are attached to each other by means of aligned keyways which extend into the output shaft outer circumferential surface and the pulley inner circumferential surface, and a corresponding key. Optionally, other suitable methods of attachment are utilized, including, but not limited to, correspondingly splined surfaces, set screws, and/or others.

Accordingly, when the output shaft of prime mover 100 rotates, input pulley 131 correspondingly rotates. And when input pulley 131 rotates, it generally drives belt 122 across at least part of the pulley outer circumferential surface, whereby belt 122 is driven by input pulley 131, traverses one of idlers 80A, 80B, thereby generally perpendicularly changing direction of travel, drivingly rotates transaxle pulley 10B, traverses the other one of idlers 80A, 80B, and returns to input pulley 131, generally continuously.

In other words, the portion of belt 122 which arcuately extends about the outer circumferential surface of idlers 80A, 80B, at any given point in time, communicates with about 25% of the outer circumferential surfaces of idlers 80A, 80B. And since belt 122 extends between pulley 131, which has generally horizontal axis of rotation, and transaxle pulley 10B, which has a generally vertical axis of rotation, the belt generally arcuately defines about a 90 degree change of direction about the outer circumferential surfaces of idlers 80A, 80B.

The outside diameter of input pulley 131 is selected in combination with the outside diameter of transaxle pulley 10B to realize a desired overall rotational speed reduction or rotational speed increase, between the prime mover output shaft and transaxle input shaft "I-S", as desired.

In transmitting power from pulley 131, changing directions about idlers 80A, 80B, to transaxle pulley 10B, belt 122 is generally maintained in a suitable state of tension and/or tightness by the belt tensioner mechanism defined by bracket 70, idler support member 72, and spring 78, in combination. Namely, the spring force provided by spring 78 biases, by pivoting idler support member 72, idler 80A generally away from prime mover 100, which tightens and/or tensions belt 122 which generally prevents the belt from non-desired slippage across the surface of e.g. transaxle pulley 10B and/or input pulley 131.

Input pulley 131 further includes an output shaft which extends into and is operably connected to the input mechanism of the electromagnetic clutch mechanism. The electromagnetic clutch mechanism includes a magnetic coil therein which engages the clutch when energized and disengages the clutch when de-energized. The output device of the electromagnetic clutch mechanism includes an output shaft which is attached to clutched pulley 132.

As desired, a user energizes the electromagnetic clutch mechanism which engages the clutch and clutchingly couples input pulley 131 to clutched pulley 132. Then as desired, the user de-energizes the electromagnetic clutch mechanism which clutchingly disengages input pulley 131 and clutched pulley 132 from each other.

Clutched pulley 132 has an outer circumferential surface with is adapted and configured to drivingly convey a belt, e.g. belt 140, across at least a portion thereof. And clutched pulley 132 has an outside diameter which is selected, for example, in combination with corresponding outside diameters of cooperating pulleys and/or idlers to realize a desired overall rotational speed reduction and/or rotational speed increase at the driven component.

Pulley brake 135 is adapted and configured to mechanically and frictionally mitigate the rotational travel of clutched pulley 132 e.g. when electromagnetic clutch 130 is de-energized. In other words, when electromechanical clutch 130 is not energized, pulley brake 135, or components thereof, actuate so as to, for example, frictionally interface with the outer circumferential surface, of clutched pulley 132, or a flange or disc which is in rotational unison with the clutched pulley. Such frictional interface is realized in numerous suitable ways, including but not limited to, pressing, squeezing, biasing, and/or otherwise frictionally interfacing. Pulley brake 135 can be a separate, distinct, component from other components of the electromagnetic clutch and pulley assembly, optionally integral therewith.

Belt 140 has a cross-sectional profile, and/or other dimensional characteristics, which enable it to suitably rotate about pulleys and/or idlers and change directions and/or planes of rotational travel. Belt 140 can be any of a variety of suitable belts and/or other continuous bands of material adapted and configured to transmit power. Such suitable belts include, but are not limited to, various belts e.g. polyurethane based belts, neoprene based belts, Kevlar based belts and Kevlar reinforced belts, polyester based belts, rubber based belts, steel reinforced belts, cable reinforced belts, cordedly reinforced belts, and/or others.

Referring now to FIGS. 2A and 3, belt 140 transmits the rotational force provided by clutched pulley 132 to force transmission device 290, which in turn transmits force to e.g. auger assembly 300.

Force transmission device 290 includes sprocket 321, pulley 351, belt tensioner 352, sprocket 355, chain 356, sprocket 358, gearbox 360, sprocket 371, chain 382, and chain slides 390. Sprocket 321 is, for example, a toothed gear or sprocket which is operably attached to e.g. rotatable components of auger assembly 300, and is adapted and configured to be drivingly rotated by a chain.

Pulley 351 is positioned generally below electromagnetic clutch 130, and rotates about an axis of rotation which is generally parallel to the axis of rotation of input pulley 131 and clutched pulley 132. Pulley 351 has an outer circumferential surface adapted and configured to interface with and be driven by belt 140 which is powered by clutched pulley 132.

Belt tensioner 352 is attached to a bracket which extends upwardly from the upper surface of chassis top wall 7A and includes an idler which is positioned generally between clutched pulley 132 and pulley 351. The belt tensioner 352 is adapted and configured to communicate with belt 140, whereby belt 140 traverses the outer circumferential surface of the idler. Belt tensioner 352 is manually adjustable, optionally automatically or self adjusting.

In manually adjustable embodiments of belt tensioner 352, the tensioner includes, for example, a mounting plate, an actuating mechanism, and an idler which is rotatably mounted to the actuating mechanism. By, for example, rotating a threaded rod portion of the actuating mechanism, a user can, as desired, move the idler in at least first and second directions, which corresponds to applying relatively more or relatively less force upon belt 140 through the tensioner idler, which corresponds to a relatively greater belt tension or a relatively lesser belt tension.

Sprocket 355 is, for example, a toothed gear or sprocket which is operably attached to pulley 351 and generally transmits power, in combination with a chain, to gearbox 360. Namely sprocket 355 is generally coaxially aligned, and locked into rotational unison, with pulley 351, whereby rotation of the pulley correspondingly realizes a rotation of the sprocket enabling pulley 351 and sprocket 355 to rotate at the same speed of rotation.

Chain 356 drivingly and rotatably connects sprocket 355 with gearbox 360. In other words, the rotational force of sprocket 355 is transmitted to e.g. an input shaft of gearbox 360, by way of chain 356.

Sprocket 358 is, for example, a toothed gear or sprocket which is operably attached to, and rotates in unison with, an input shaft of gearbox 360. Suitable methods of attaching sprocket 358 to the gearbox input shaft include, but are not limited to, corresponding keyways and keys, correspondingly splined surfaces, set screws, and/or others. The outside diameter of sprocket 358 is selected in light of e.g. the outside diameter of sprocket 355, pulley 351, and/or others, to realize a desired rotational speed reduction and/or speed increase, whereby the input shaft of gearbox 360 rotates with a desired rotational speed.

Figure 10:
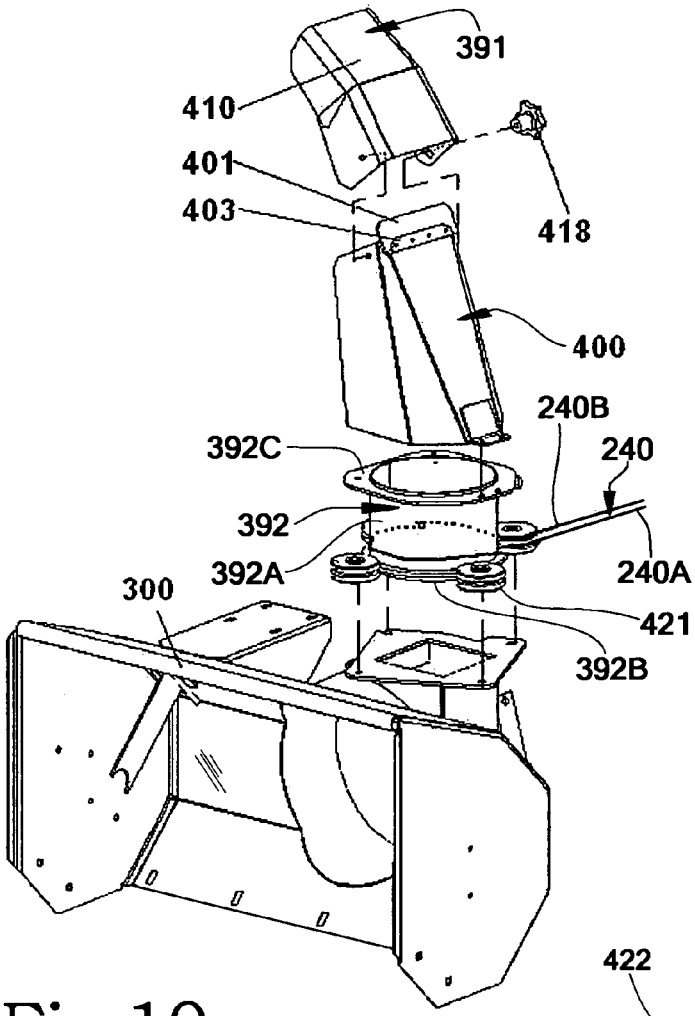
FIG. 10 shows an exploded, pictorial, view of parts of the auger assembly and discharge chute assembly of FIG. 1A.

Gearbox 360 includes a gearbox housing, an input shaft, a gear assembly, an output shaft, and sprocket 371 which is connected to the output shaft. Gearbox 360 is attached to a generally planar mounting plate which extends generally parallel to the ground, and outwardly and back from auger assembly 300 (FIG. 10).

The gearbox housing is a generally sealed unit, whereby lubricating fluid can be generally and suitably retained therein, as desired. The input and output shafts each extend outwardly from respective, e.g. sidewalls of the gearbox housing, and extend generally perpendicularly to each other. The input shaft is operably coupled to sprocket 358 and the output shaft is operably coupled to sprocket 371.

The gear assembly of gearbox 360 includes any of a variety of suitable cooperating gears and corresponding hardware, adapted and configured to transmit rotational movement, generally perpendicularly. Exemplary of such suitable cooperating gears and corresponding hardware arrangements include, but are not limited to, ring and pinion gear arrangements, corresponding bevel gear arrangements, corresponding spiral-cut bevel gear arrangements, corresponding worm gear arrangements, and/or others.

Sprocket 371 is, for example, a toothed gear or sprocket, attached to the output shaft of gearbox 360, and adapted and configured to transmit rotational energy from the gearbox output shaft to sprocket 321 which communicates with auger assembly 300. Suitable methods of attaching sprocket 371 to the gearbox output shaft include, but are not limited to, corresponding keyways and keys, correspondingly splined surfaces, set screws, and/or others.

The outside diameter of sprocket 371 is selected in light of e.g. the outside diameter of sprocket 321, to realize a desired rotational speed reduction and/or speed increase, whereby rotatable components of auger assembly 300 generally rotate at a desired rotational speed.

Chain 382 drivingly and rotatably connects sprocket 321 with sprocket 371 and thus with gearbox 360. In other words, the rotational energy of the gearbox output shaft is transmitted through sprocket 371, through chain 382, to sprocket 321, and ultimately to auger assembly 300.

Chain slides 384, 390 are generally cylindrical, preferably polymeric members. Brackets which extend upwardly from one of, for example, the upper surface of chassis top wall 7A or an upper surface of chute assembly 300, provide the mounting mechanism through which respective ones of chain slides 384, 390 are attached to the remainder of snow blower 1. The outer circumferential surfaces of chain slides 384, 390 interface with the outwardly facing surfaces of chains 356 and 382, respectively, whereby the chain slides 384, 390 generally mitigate any non-desired slack in chains 356, 382 while in operation.

Preferably, the brackets to which chain slides 384, 390 are mounted include elongate slots which enable a user to adjust and/or otherwise modify the respective positions of chain slides 384, 390 relative to chains 356, 382. In otherwords, chain slides 384, 390 are preferably adjustable, whereby a user can e.g. move ones of the slides relatively more proximate the respective chain and/or move ones of the slides relatively more distal the respective chain, which allows relatively less or more slack in such chain and/or chains.

Snow blower 1 preferably includes various shields and/or guards which generally encapsulate at least portions of movable chain assemblies, such as various components which cooperate with chain 356 and/or chain 382, and/or other components. Such shields offer protection to users from certain hazards posed by moving parts and offer protection to the moving parts themselves from e.g. environmental exposure. Exemplary of such shields are chain back covers 520, 530 chain front covers, 550, 560, and clutch cover 570.

Referring now to FIG. 3, auger assembly 300 includes auger housing 301, auger shaft 312, auger brackets 315, auger blade 320, sprocket 321, impeller housing 325, and impeller 350.

Auger housing 301 includes housing top wall 301A, housing back wall 301B, housing sidewalls 301C, 301D, skids 304, 305 and scraper 310. Auger housing 301 and the auger generally define a first stage, e.g. the snow collection stage, of snow blower 1. Housing top wall 301A is a generally planar sheet, panel and/or plate with an upper surface, a lower surface and front and back edges. Top wall 301A generally defines an uppermost portion of auger housing 301.

Housing back wall 301B has, for example, three distinct sections which in combination define a generally angulated back wall structure, each of which is a generally planar sheet, panel and/or plate. The uppermost section of back wall 301B intersects with and is attached to the back edge of housing top wall 301A, and extends generally downwardly and back therefrom. The second section of back wall 301B extends downwardly from the first back wall section, generally perpendicular to the ground. The third section of back wall 301B extends generally downwardly and forward of, e.g. generally toward the front of snow blower 1, the second back wall portion. In other words, the three sections of back wall 301B, in combination, define a forward facing surface which is generally concave.

Back wall 301B further includes an opening 302 which extends therethrough, and which includes a leading tapered section 303. The opening communicates with impeller housing 325, whereby the impeller and auger housings are cooperatively joined.

Housing sidewalls 301C, 301D generally define the lateral sides of auger housing 301. Each of sidewalls 301C, 301D is a generally planar sheet, panel and/or plate, and each is attached to housing top wall 301A and back wall 301B. The sidewalls 301C, 301D are positioned generally perpendicular to the ground, and define inwardly facing surfaces, which face toward each other. Portions of the perimeter of housing sidewalls 301C, 301D match the profile of the combination of top wall 301A and back wall 301B.

Accordingly, auger housing 301 defines a partially enclosed structure which is open at its front-most portion and lower-most portion, enabling the auger to generally freely interface the snow while in use. Various surfaces such as the lower surface of top wall 301A, the forward facing surface of back wall 301B, and the inwardly facing surfaces of sidewalls 301C, 301D, define the outer perimeter of an auger housing cavity.

Preferably, the auger housing cavity, and thus auger housing 301, houses the auger and various components of the auger drive mechanism, e.g. sprocket 321, at least a portion of chain 382, and/or others, therein. In such embodiments, an aperture extends through ones of top wall 301A and/or back wall 301B, which enables passage of chain 382 into and out of the auger housing cavity. As desired, the assemblage of auger housing 301 further includes chain guard 510 which generally covers, envelopes, and/or otherwise encloses, for example, sprocket 322 and/or the portion of chain 382 which passes into the auger housing cavity.

Skids 304, 305, and scraper 310 generally protect various portions of auger housing 301 from excessive wear, such as abrasive wear, gouging wear, cutting wear, and/or other wear, during use. Skids 304, 305 are adjustably attached to the lower, front, corners of sidewalls 301D and 301C, respectively. Thus, skids 304, 305, generally interface with the ground or other underlying surface, e.g. concrete or asphalt surface, during use, and can be adjusted so that the lower edges of sidewalls 301C, 301D are spaced relatively further from or relatively nearer to such underlying surface, as desired.

Scraper 310 is a generally elongate, rigid, member which is adjustably attached to the lowermost portion of back wall 301B. Thus, scraper 310 generally interfaces with the ground surface during use, and can be adjusted so that the lower edges of back wall 301B and/or sidewalls 301C, 301D are spaced relatively further from or relatively nearer to such underlying surface, as desired.

The auger includes auger shaft 312, auger brackets 315, auger blade 320, sprocket 321, and flange 322. Auger shaft 312 is an elongate, generally cylindrical member which extends across the width of, and generally medially through, the auger cavity. In other words, auger shaft 312 extends generally between, and is rotatably mounted to, sidewalls 301C and 301D. Namely, auger shaft 312 is rotatably mounted to the inwardly facing surfaces of sidewalls 301C, 301D by way of, for example, bearings 330 and adapter 331. Bearings 330 are mounted to the first and second ends of auger shaft 312. Adapters 331 housingly capture the bearings and are mounted to sidewalls 301C, 301D, thus rotatably mounting the auger to auger housing 301.

Auger brackets 315 extend radially outwardly from the outer circumferential surface of auger shaft 312. The auger brackets 315 are radially and axially spaced from each other upon the outer circumferential surface of auger shaft 312. The ends of auger brackets 315 which are distal auger shaft 312 are connected to auger blade 320.

Auger blade 320 extends generally helically along the length of and radially spaced from auger shaft 312. Auger blade 320 is adapted and configured to pull, drag, scoop, and/or otherwise draw, snow into the auger housing cavity and move such snow generally toward the rearmost portion of the auger cavity. Since the auger drive mechanism is adjacent at least one of sidewalls 301C, 301D, auger blade 320 helically extends generally continuously along a major portion of the length of auger shaft 312, e.g. along the full length of the auger shaft as shown, generally without any discontinuities in the blade. In other words, auger blade 320 defines a generally continuous cut path along the width of the auger housing, without any uncut portion which ordinarily corresponds to a discontinuous blade.

Impeller housing 325 and impeller 350 generally define a second stage, e.g. a snow discharge stage, of snow blower 1. Impeller housing 325 is a generally cylindrical tube, having an outer wall. The inner surface of the outer wall generally defines the outer perimeter of a cavity, namely an impeller cavity.

The front-most portion of the impeller housing outer wall, namely at tapered section 303 of opening 302, is attached to back wall 301B. From this locus of joinder with auger housing 301, the impeller housing outer wall extends toward the rear of the snow blower. The outer perimeter defined by the impeller housing outer wall corresponds generally in size, shape, and configuration to the outer perimeter defined by the opening which extends through auger housing back wall 301B, whereby the auger cavity generally opens into the impeller cavity.

The rearmost portion impeller housing 325 has an opening extending therethrough, which permits access to the impeller cavity from e.g. the portion of impeller housing 325 which is proximate prime mover 100. Cover 500 is removably attached to the rearmost portion of impeller housing 325, whereby cover 500 is adapted and configured to selectively seal and/or cover the rear opening of the impeller cavity, as desired by the user.

The upper portion of impeller housing 325 includes housing top flange 327. Housing top flange 327 is generally planar, and has upper and lower surfaces. An opening extends generally medially through the thickness of flange 327 and extends into the impeller cavity. At lease one bore, preferably at least three, more preferably at least four bores, extend vertically through the thickness of flange 327, adjacent the flange outer perimeter.

Impeller 350 includes impeller back plate 350A and impeller blades 350B, and is adapted and configured to rotate within the impeller cavity and throw, push, and/or otherwise propel, snow from the impeller cavity.

Impeller back plate 350A is a generally planar, circular, member which is positioned generally upright. Back plate 350A has a forward facing surface and a rearward facing surface, and a bore which extends generally medially and axially therethrough. The forward facing surface of back plate 350A faces the auger and the rearward facing surface faces e.g. prime mover 100.

Impeller blades 350B are each a generally rigid member which extends axially from the forward facing surface of back plate 350A, and can extend radially beyond the perimeter of the back plate. Preferably, ones of the ends of blades 350B which are proximate the back plate medial bore communicate with and/or are attached to respective other ones of the ends of blades 350B, whereby the blades are generally attached to each other as well as to the back plate.

Impeller 350 rotates within the impeller cavity through an attachment of the impeller to, for example, shaft 345 (FIG. 3) which runs axially through and is attached to pulley 351, sprocket 355, and/or otherwise is suitably locked into rotational unison with e.g. pulley 351 and/or sprocket 355 (FIG. 2A).

Shaft 345, is locked in rotational unison with impeller 350, and receives rotational energy from pulley 351, sprocket 355, and/or others, directly or indirectly. Impeller shaft 345, and thus impeller 350 are rotatably mounted to impeller housing 325 by way of, for example, bearing housing 340 and bearings 344.

Bearing housing 340 is attached to a rearmost portion of impeller housing 325, at bores 353 (FIG. 6). Bearings 344 are housed in bearing receiving cavities of bearing housing 340, on generally opposite axial sides thereof. Impeller shaft 345 operably extends through bearings 344, thus through bearing housing 340, outwardly beyond impeller housing 325, and is cooperatively coupled to a suitable, selectively rotating, component, such as pulley 351, sprocket 355, and/or others, directly or indirectly, which is driven by prime mover 100.

Figure 11:
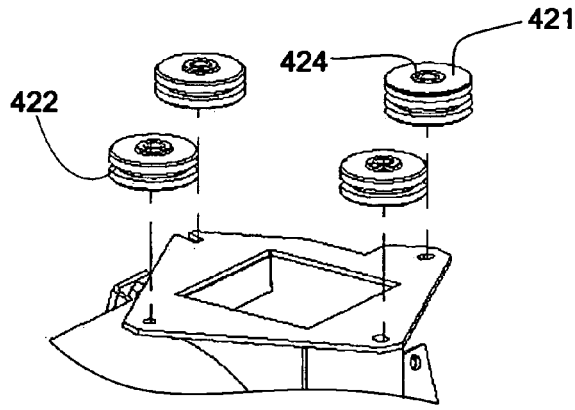
FIG. 11 shows an exploded, pictorial, view of parts of the discharge chute assembly of the snow blower apparatus of FIG. 1A.

Referring now to FIGS. 10 and 11, discharge chute assembly 391, includes cable 240, chute lower member 392, chute rotation body 392A, chute lower flange 392B, chute upper flange 392C, chute upper member 400, transition member 401, discharge deflector 410, and idlers 421.

Chute lower member 392 includes chute rotation body 392A, chute lower flange 392B, and chute upper flange 392C. Chute rotation body 392A is a generally cylindrical structure with a generally continuous, annular, outer wall. A vertically extending bore extends axially through the chute rotation body and extends into and communicates with the impeller cavity.

Chute lower flange 392B is generally annular, has an upper surface, a lower surface, and extends radially outwardly from the lower end surface of chute rotation body 392A. Lower flange 392B extends along a major portion, optionally the entirety, of the outer circumferential surface of chute rotation body 302A.

Chute upper flange 392C has an upper surface, a lower surface, and extends radially outwardly from the upper end surface of chute rotation body 392A. Upperflange 392C extends along a major portion, optionally the entirety, of the outer circumferential surface of chute rotation body 302A. Upper flange 392C further includes a plurality of bores which extend through the thickness thereof and are adapted and configured to enable chute upper member 400 to mount thereto.

Chute upper member 400 is attached to upper flange 392C by way of the flange bores and corresponding hardware, and has a back wall and two sidewalls. The upper member back wall extends upwardly and angularly from upper flange 392C and has first and second lateral edges. The upper member sidewalls extend from respective ones of the first and second back wall lateral edges, whereby the entire assemblage of chute upper member 400 generally defines a 3-sided, generally upright, trough.

Transition member 401 is an elongate, generally rectangular member which extends across generally the entire width of, and is attached to, the uppermost portion of the chute upper member back wall. A plurality of rivets 403 attach transition member 401 to the upper portion of chute upper member 400. Preferably, transition member 401 is made from a deflectable, resilient, and/or otherwise bendable, material.

Discharge deflector 410 is pivotably attached to the upper portion of chute upper member 400, has a back wall, and first and second sidewalls. Each of the sidewalls of discharge deflector 410 is pivotably attached to an upper portion of a corresponding sidewall of chute upper member 400.

Knob 418 is a securing structure with e.g. a threaded stem portion and a handle portion. By way of the threaded stem portion, or otherwise, knob 418 is adapted and configured to generally lock discharge deflector 410 in place, when in a tightened state, and generally permit discharge deflector 410 to pivot, when in a loosened state. Accordingly, a user uses knob 418 and discharge deflector 410 to generally direct the vertical angle component at which snow is discharged from discharge chute assembly 391.

Idlers 421 are adapted and configured to guide and support, for example, discharge chute assembly 391. Namely, idlers 421 generally support and guide chute rotation body 302A, enabling the rotation body to rotate, through an e.g. rotatably rolling, sliding, gliding, and/or other suitable interfacing relationship between the rotation body of lower flange 392B of lower chute 392, and the idlers.

Each of idlers 421 is generally cylindrical, in other words a wheel type structure, which is positioned with the circular surfaces facing generally upwardly and downwardly, whereby each idler 421 is adapted and configured to rotate about a generally vertical axis of rotation.

The outer circumferential surface of each idler 421 has a groove, channel, and/or other depression, extending thereinto. Namely, groove 422 extends into the outer circumferential surface of ones of idlers 421. In some embodiments, groove 422 extends along a minor portion of the outer circumferential surface of idler 421. In some embodiments, groove 422 extends along a major portion of the outer circumferential surface of idler 421. In some embodiments, groove 422 extends along the entirety of the outer circumferential surface of idler 421. In some embodiments, ones of idlers 421 include a plurality of grooves extending into the respective outer circumferential surfaces of each idler. Ones of the grooves 422 are generally parallel, optionally generally not parallel, to other ones of the grooves on any particular idler 421.

The outside diameter of each idler 421, and the depth, width, profile, contour, and/or other characteristics of groove 422 are selected so that sufficient surface area of various portions of idlers 421 interface with corresponding portions of e.g. chute lower flange 392B, to yield the desired result and functionality. Accordingly, groove 422 defines a groove width which is greater in magnitude than the magnitude of the thickness dimension of chute lower flange 392B. And groove 422 defines a depth dimension having a magnitude that corresponds to the magnitude of the distance from which lower flange 392B radially extends from chute rotation body 392A.

Regardless, idlers 421 generally rotationally capture chute lower member 392, whereby the chute lower member is generally free to rotate with respect to e.g. impeller housing 325, as desired. Also, idlers 421 interface with chute lower member 392 so as to retain a sufficiently close distance relationship between the lower surface of chute lower flange 392B and the upper surface of impeller housing top flange 327, thereby suitably mitigating the amount of non-desired snow escape between the impeller housing and the discharge chute assembly during use.

Specifically, ones of idlers 421 are mounted, rotatably, optionally fixedly, to the impeller housing top flange 327 (FIG. 11), by way of the bores which extend through top flange 327. Grooves 422 on respective idlers 421 are generally coplanar with respect to each other.

Idlers 421 are made from any of a variety of suitable, preferably polymeric, materials. Preferably, idlers 421 are made from nylon or a blended nylon material, which enables portions of discharge chute assembly 391 to pivot, rotate, and or otherwise move, for example smoothly, within the movement boundary generally defined by the idlers.

Lower flange 392B is housed generally concentrically within an imaginary circle defined arcuately connecting the idlers. The flange 392B is generally captured in a portion of each of the grooves 422, in each of the idlers 411.

The upwardly facing surface of the annular projection generally at the bottom of 422 generally provides load bearing support to discharge chute assembly 391, generally supporting the chute assembly 391 from impeller housing 325.

The downwardly facing surface of groove 422 generally provides a vertical retaining functionality to discharge chute assembly 391. Thus, the downwardly facing surface of the groove 422 generally resists forces which tend to urge removal of the chute assembly 391, upwardly away from impeller housing 325.

The portion of an idler 421 which is laterally adjacent the inwardly extending most portion of groove 422 generally provides lateral retaining functionality to discharge chute assembly 391. Thus, the portion of idler 421 which is laterally adjacent the inwardly extending most portion of groove 422 at least partially resists forces with tend to urge lateral removal of chute assembly 391 from impeller housing 325.

Spacers 424 are insertably housed in the inner bores of idlers 422. Spacers 424 enable idlers 421 to rotate upon and around, for example, mounting bolts which extend axially therethrough. In addition, spacers 424 are sufficiently durable, tough, hard, and/or resilient enabling the spacers to generally reduce the likelihood that idlers 421 will be damaged during installation by, e.g. axially crushing and/or otherwise damaging the idlers by over-tightening of the idler mounting bolts. Spacers 424 can include a variety of suitable structures, including, but not limited to, various spacers, sleeves, collars, bearings, bearing assemblies, and/or others.

Preferably idlers 421 are rotatably mounted to impeller housing 325, whereby the idlers and chute rotation body rotate during rotation of discharge chute assembly 391. However, idlers 421 can remain static as long as the coefficient of friction realized between chute lower flange 392B and idlers 421 is sufficiently low to enable the flange to suitably slide across the idlers.

To rotate chute assembly 391, a user applies a force to cable 240. Cable 240 includes first cable segment 240A and second cable segment 240B. Cable 240 is elongate, generally flexible, and includes any of a variety of suitable structures which include, but are not limited to, various cables, ropes, bands, and/or other generally flexible elongate and generally non-extensible members.

First and second cable segments 240A, 240B extend around at least a portion of the outer circumferential surface of chute rotation body 392B, in respectively opposite directions. Namely, first and second cable segments 240A, 240B extend, in different directions, about rotation body 392A and are each attached to the rotation body wall, optionally at a generally common locus.

Accordingly when a force is applied to first cable segment 240A, urging the cable segment in a direction generally away from rotation body 392A, the force is transferred through cable segment 240A, to the point of attachment of the cable to the rotation body, whereby the rotation body correspondingly rotates. In other words, as a portion of first cable segment 240A is pulled away from the rotation body, a portion of second cable segment 240B is pulled toward the rotation body, whereby relatively less of first cable segment 240A interfaces with and lies upon rotation body 392A and relatively more of second cable segment 240B interfaces with and lies upon rotation body 392A. Namely, a portion of first cable segment 240A is unwound from rotation body 392A and second cable segment 240B is wound upon the rotation body.

When a force is applied to second cable segment 240B, in a direction generally away from rotation body 392A, the force is transferred through cable segment 240B, to the point of attachment of the cable to the rotation body, whereby the rotation body correspondingly rotates. In other words, as a portion of second cable segment 240B is pulled from the rotation body, a portion of the first cable segment 240A is pulled toward the rotation body, whereby relatively less of second cable segment 240B interfaces with and lies upon rotation body 392A and relatively more of first cable segment 240A interfaces with and lies upon rotation body 392A. Namely, a portion of second cable segment 240B is unwound from rotation body 392A and an additional portion of first cable segment 240A is wound upon the rotation body.

Figure 5:
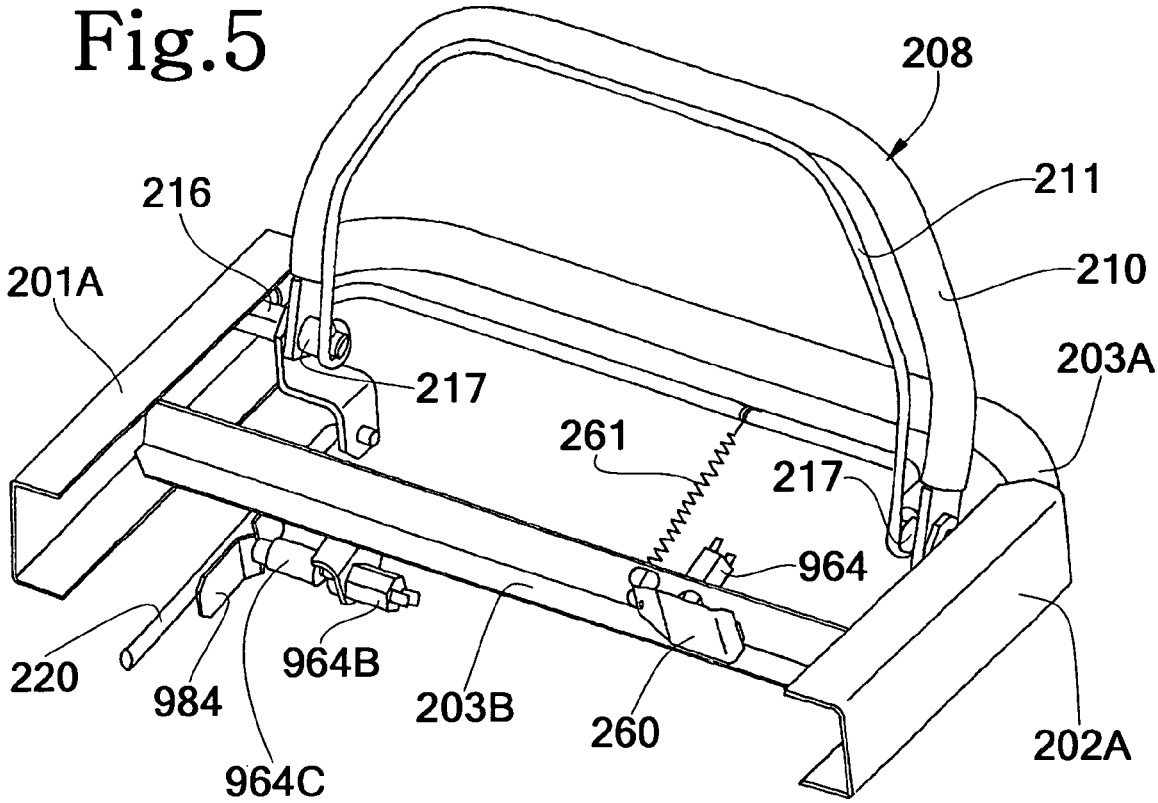
FIG. 5 shows an enlarged, pictorial, view of a portion of the handle assembly of FIG. 1A.

Regarding various user control mechanisms, and referring now to FIGS. 4 and 5, handle assembly 200 includes handle arms 201A, 202A, handle arm angled portions 201B, 202B, handle mounting plates 201C, 202C, handle cross member 203A, panel mounting bracket 203B, and panel assembly 590. Handle assembly 200 functions as a lever arm, which enables a user to control snow blower 1 by way of e.g. pushing, pulling, pivoting, and/or otherwise moving the snow blower.

*Handle arm 201A is an elongate, generally rigid member which alone and/or in combination with other components provides mounting structure to which e.g. handle cross member 203A, panel mounting bracket 203B, and panel assembly 590 are mounted. As illustrated, handle arm 201**A is an elongate piece of C-channel metal stock, although other suitable materials and configurations are considered and well within the scope of the invention. Such other suitable materials and configurations include, but are not limited to, various configurations of metal tubing, angle iron, I-beam, and/or other metallic or nonmetallic stock.

A first end of handle arm 201A is relatively distal running gear 5 and a second, opposite, end of handle arm 201A is relatively proximate running gear 5. The second end of handle arm 201A generally defines a beveled surface, as viewed from above, which is adapted and configured to interface with handle arm angled portion 201B.

Handle arm angled portion 201B is an elongate, generally rigid member which has a shorter length than, and is made from e.g. generally the same material as, handle arm 201A. Angled portion 201B has first and second ends, each of which defines a beveled terminal surface.

The uppermost end of angled portion 201B, and its beveled surface, interfaces with the beveled surface of the lowermost end of handle arm 201A. As desired, handle arm 201A and angled portion 201B are welded to each other, optionally integral, optionally otherwise suitably joined or communicating with each other. In the complete assemblage of handle assembly 200, angled portion 201B extends from handle arm 201A inwardly toward, for example, chassis 7 and handle mounting plate 201C.

Handle mounting plate 201C is a generally planar member which has an inwardly facing surface which faces toward e.g. chassis 7 and an outwardly facing surface which faces a generally opposite direction. Handle arm angled portion 201B is connected to the outwardly facing surface of mounting plate 201C. The inwardly facing surface of mounting plate 201C interfaces with an outwardly facing surface of chassis frame rail 7G (FIG. 4). Mounting plate 201C is attached to the frame rail 7G by way of, for example, coaxially aligned bores on the frame rail 7G and mounting plate 201C and suitable hardware which extends through such aligned bores, including various bolts, rivets, screws, and/or others.

Like handle arm 201A, handle arm 202A is an elongate, generally rigid member which alone and/or in combination with other components provides mounting structure to which e.g. handle cross member 203A, panel mounting bracket 203B, and panel assembly 590 are mounted. As illustrated, handle arm 202A is an elongate piece of C-channel metal stock, although other suitable materials and configurations are considered and well within the scope of the invention. Such other suitable materials and configurations include, but are not limited to, various configurations of metal tubing, angle iron, I-beam, and/or other metallic or nonmetallic stock.

A first end of handle arm 202A is relatively distal running gear 5 and a second, opposite, end of handle arm 202A is relatively proximate running gear 5. The second end of handle arm 202A generally defines a beveled surface, as viewed from above, which is adapted and configured to interface with handle arm angled portion 202B.

Handle arm angled portion 202B is an elongate, generally rigid member which has a shorter length than, and is made from e.g. generally the same material as, handle arm 202A. Angled portion 202B has first and second ends, each of which defines a beveled terminal surface.

The uppermost end of angled portion 202B, and its beveled surface, interfaces with the beveled surface of the lowermost end of handle arm 202A. As desired, handle arm 202A and angled portion 202B are welded to each other, optionally integral, optionally otherwise suitably joined or communicating with each other. In the complete assemblage of handle assembly 200, angled portion 202B extends from handle arm 202A inwardly toward, for example, chassis 7 and handle mounting plate 202C.

Handle mounting plate 202C is a generally planar member which has an inwardly facing surface which faces toward e.g. chassis 7 and an outwardly facing surface which faces a generally opposite direction. Handle arm angled portion 202B is connected to the outwardly facing surface of mounting plate 202C. The inwardly facing surface of mounting plate 202C interfaces with an outwardly facing surface of chassis frame rail 7F (FIG. 4). Mounting plate 202C is attached to the frame rail 7F by way of, for example, coaxially aligned bores on the frame rail 7F and mounting plate 202C and suitable hardware which extends through such aligned bores, including various bolts, rivets, screws, and/or others.

Thus, handle assembly 200 is operatively attached to e.g. running gear 5 though the attachment of handle mounting plates 201C, 202C and chassis frame rails 7G, 7F, respectively.

Handle cross member 203A extends generally perpendicularly between, and is attached to, the uppermost ends of handle arms 201A and 202A. Handle cross member 203A is attached to handle arms 201A, 202A by way of, for example, but not limited to, screws, bolts and nuts, rivets, weldments, and/or others.

Handle cross member 203A has a generally straight-line, linear, medial portion and first and second generally arcuate ends. The first and second ends arcuately span approximately 90 degrees, whereby the ends arcingly transition from the handle arms 201A, 202A, to the medial portion of cross member 203A.

Preferably, handle cross member 203A has an outer circumferential surface which is relatively comfortably for a user to grasp. In other words, handle cross member 203A is preferably devoid of any generally sharp angles and/or protuberances which might prove uncomfortable during normal use. Accordingly, handle cross member 203A has an e.g. generally cylindrical outer circumferential surface, and/or other suitably outer surface.

Panel mounting bracket 203B is an elongate member which extends between handle arms 201A, 202A, generally parallel to the medial portion of handle cross member 203A. Panel mounting bracket 203B is e.g. a piece of angle-iron type stock material, which has first and second elongate portions, generally perpendicular to each other.

In the complete assembly of handle assembly 200, one of the first and second elongate portions of panel mounting bracket 203B extends along a plane which is generally parallel the plane defined by the two out-jutting, C-channel, portions of handle arms 201A, 202A. The other one of the first and second elongate portions of panel mounting bracket 203B is generally perpendicular thereto, thus extends generally perpendicularly between the two out-jutting, C-channel, portions of handle arms 201A, 202A.

Panel mounting bracket 203B, as desired, has various apertures, bores, slots, and/or other structures or voids, which enable various components of e.g. user input assembly 208 to be mounted thereto.

User input assembly 208 includes drive handlebar 210, power take off (PTO) bail 211, pins 216, drive control draw rod 220, lower draw rod 221, pivotable bracket 260, spring 261, panel assembly 590, power take off safety switch 964A, neutral safety switch 964B, solenoid 965, draw rod guide-plate 982, and neutral safety switch ramp-plate 984. Drive handlebar 210 is a generally U-shaped, preferably tubular, member, and is pivotably connected adjacent the upper ends of handle arms 201A, 202A.

A first bore extends through each of the generally planar portions or mounting tabs, of the first and second handlebar ends, generally coaxially with each other. In the complete assemblage of handle assembly 200, the first bore of the first and second handle bar ends generally define the point of pivotation from which the drive handlebar 210 pivots.

A second bore extends through the generally planar portion or mounting tab of the handlebar end which is proximate handle arm 201A. This second bore is adapted and configured to operably connect, by way of, for example other components, drive handlebar 210 to transaxle assembly 10. In some embodiments, this second bore extends through a separate component, such as a pivotable bracket, which is operatively connected, for example, by way of keys and corresponding keyways, corresponding splines, setscrews, and/or otherwise, to drive handlebar 210.

The outer circumferential surface of is relatively comfortably for a user to grasp. Thus, drive handlebar 210 is preferably devoid of any generally sharp angles and/or protuberances which might prove uncomfortable during normal use.

In addition to the configuration of the outer circumferential surface, drive handlebar 210 has a suitable overall shape, profile, and/or other characteristics, whereby the drive handlebar 210 is generally ergonomically acceptable to the user. Accordingly, handle cross member 203A has an e.g. generally cylindrical outer circumferential surface, other suitably outer surface, and/or is generally U-shaped, V-shaped, split U-shaped, split V-shaped, or otherwise suitably shaped to enable a user to enjoy a relatively comfortable arm and hand position, as well as gate, while using snow blower 1 e.g. while pushing, pulling, and/or otherwise manipulating drive handlebar 210.

*PTO safety bail 211 is a generally U-shaped member and a generally straight-line linear, lower cross member. The lower cross member has relatively tightly radiused arcuate ends, which extend between and connect the two ends of the lower cross member to the U-shaped member of bail 211. The terminal most portion of each end of PTO bail 211 includes a bore which extends therethrough. The bores of the ends of PTO bail 211 generally define a point of pivotation, whereby safety bail 211 is pivotably attached to handle arms 201A, 202**A.

Accordingly, both the U-shaped member and the lower cross member pivot about a point of pivotation defined by the PTO bail end bores. Since the U-shaped member extends relatively further from the end bores as compared to the lower cross member, the lower cross member travels relatively less linear distance as compared to the U-shaped member, for any given pivotation of PTO bail 211 about the end bores.

Referring specifically to FIG. 5, in the complete assemblage of user input assembly 208, the bores of PTO bail 211 and the first bores of drive handlebar 210 are generally coaxially aligned with each other. Thus, drive handlebar 210 and the U-shaped member of PTO bail 211 generally pivot about the same points of pivotation. Also, drive handlebar 210 and the U-shaped member of PTO bail 211 define a generally similar U-shaped profile which enables the handlebar and PTO bail to pivotably move in unison with each other. In otherwords, a user can grasp both drive handlebar 210 and PTO bail 211 simultaneously in a given hand and correspondingly and conveniently manipulate the handlebar and bail simultaneously with the same hand. Accordingly, drive handlebar 210 and PTO bail 211, in combination, define a pivotable user control device, e.g. an infinitely variable push and go and/or pull and go device which is generally ergonomically acceptable to the user.

Each of pins 216 pivotably attaches a respective end of handlebar 210 and PTO bail 211 to the corresponding ones of handle arms 201A, 202A. Each pin 216 is elongate, has a bore which extends axially therethrough, and has a first portion and a second portion. The first portion of pin 216 defines a multiple sided outer surface and an end surface. As one example, the end surface of the first portion appears hexagonal when viewed in elevation and the outer surface includes six elongate flat surfaces intersecting each other at respective ends.

The second portion of pin 216 has a generally round end surface of relatively lesser diameter than the width of the first portion. In other words, the second portion extends axially from the first portion, is generally cylindrical, and thus defines a generally smooth outer circumferential surface. Pin 216 includes a shoulder which steps down the pin diameter from the first portion to the second portion. In other words, pin 216 includes, but is not limited to, various suitable hexagonal standoffs and/or spacers.

One pin 216 extends outwardly from the inwardly facing surface of handle arm 201A, with the end surface of the first pin portion interfacing with such handle arm inwardly facing surface. A second pin 216 extends outwardly from the inwardly facing surface of handle arm 202A, with the end surface of the first pin portion interfacing with such handle arm inwardly facing surface.

As desired, pins 216 can further include spacers 217. Each spacer 217 is a generally cylindrical member and is adapted and configured to e.g. slidingly, rollingly, press-fittingly, and/or otherwise, be concentrically housed within the bores of ones of handlebar 210 and/or PTO bail 211 and thus relatively reduces the amount of friction between respective ones of handlebar 210, PTO bail 211, and pins 216.

Drive control draw rod 220 is an elongate, generally rigid member with an upper end and a lower end. The upper end of drive control draw rod 220 includes a projection which extends generally perpendicularly from the remainder of the draw rod 220. The projection of the draw rod upper end is insertably and rotatably housed in a second bore which extends through the generally planar portion or mounting tab of the end of handlebar 210, adjacent handle arm 201A. Namely, the connection between handlebar 210 and drive control draw rod 220 enables motion e.g. pivotable motion of the handlebar to translate to a corresponding generally linear motion of draw rod 220.

The lower end of drive control draw rod 220 includes, for example, a threaded portion and an adjustment mechanism 224 threaded thereupon (FIG. 2A). The adjustment mechanism is adapted and configured to enable a user to adjust the overall length dimension of the assemblage of drive control draw rod 220 and lower draw rod 221. Non-limiting examples of such suitable adjustment mechanisms include, but are not limited to, hexagonal spacers with two female ends, threaded rod couplers, and/or other suitable hardware, adapted and configured to e.g. threadedly draw drive control rod 220 and lower draw rod 221 relatively nearer to each other and/or to threadedly push drive control rod 220 and lower draw rod 221 relatively further from each other.

Lower draw rod 221 is an elongate, generally rigid member with an upper end and a lower end, and is relatively shorter than drive control draw rod 220. The upper end of lower draw rod 221 includes a threaded portion thereof which threadedly and adjustably interfaces with the adjustment mechanism and therefore with drive control draw rod 220. The lower end of lower draw rod 221 includes a projection which extends generally perpendicularly from the remainder of the draw rod 221. The projection of the lower draw rod upper end is insertably and rotatably housed in an aperture which extends through input bracket 30C (FIG. 2A). Namely, the rotatable connection between the bracket and lower draw rod 221 enables motion e.g. linear motion of draw rod 221 to translate to a corresponding generally pivotal motion of input bracket 30C, thus pivotal motion of input arm 30B and input control shaft 30A.

Referring now to FIGS. 2A, 4, and 5, various components of user input assembly 208, namely drive handlebar 210, pins 216, drive control draw rod 220, lower draw rod 221, and/or others, enable a user to adaptively, with infinite variation in machine output, and within certain predetermined parameters e.g. maximum speed, control the speed and travel direction of snow blower 1 along the ground or other underlying surface.

In other words, as desired, a user applies an input force such as a push or pull to drive handlebar 210 which correspondingly pivots about pins 216. This pivotal motion is translated into a generally linear motion through a linkage defined by drive control draw rod 220 and lower draw rod 221. The linear motion of drive control draw rod 220 and lower draw rod 221 is translated to another pivotal motion at the control portion of transaxle assembly 10, namely input control shaft 30A, which correspondingly influences the mechanical output of transaxle assembly 10.

Accordingly, when a user presses forward on drive handlebar 210, from a neutral rest position, snow blower 1 advances, thus travels forward. When a user pulls back on drive handlebar 210, snow blower 1 regresses, thus travels backward. The magnitude of the realized speed of snow blower 1 corresponds to the magnitude with which the user presses or pulls drive handlebar 210, forward or backward respectively, and wherein there are substantially no step changes between speeds, rather the speed of snow blower 1 is continuously variable according to the continuous variation in distance by which handlebar 210 can be moved.

A user rotates chute rotation body 392A and thus discharge chute assembly 391, by, for example, rotating chute rotation handle 230. Chute rotation handle 230 includes a handle body, and a grip assembly.

The chute rotation handle body is generally L-shaped, has a first elongate member and a second member which extends generally perpendicularly from an end of the first. The second member extends though a bore which extends through handle arm 202A, axially through generally annular spacer 231, axially through bushing 232, and is locked into rotational unison with idler 233. Thus, rotation of chute rotation handle 230 realizes a corresponding rotation of idler 233.

Chute rotation handle 230 further includes a handle assembly which generally lies laterally outside of handle arm 202A. The handle assembly including first and second grip members 236, 239, and bolt 237. Bolt 237 extends axially though grip member 236 and rotatably mounts grip member 236 to the end of the handle body first member, distal the handle body second member. Second grip member 239 sleevingly inserts over and generally encapsulates first grip member 236 and bolt 237. Accordingly, to rotate handle member 230 and idler 233, a user grips and rotates the handle assembly of e.g. grip members 236, 237.

Idler 233 is adapted and configured to windingly store portions of cable 240 thereupon, and generally lies laterally inside of handle arm 202A. Namely, first and second cable segments 240A, 240B are wound upon idler 233 in opposite directions of winding. Thus, when first cable segment 240A is relatively further wound upon idler 233, relatively more of second cable segment 240B is unwound therefrom. Accordingly, generally the same magnitude of length of cable is always wound upon idler 233, but the relative amounts of each cable segment wound thereupon changes, as desired by a user, through the rotational manipulation of chute rotation handle 230 by the user.

Cable 240 extends between idler 233 and discharge chute assembly 391, and along the length of the cable, passes over, and generally changes direction of extension over, idler 250. Spacer 251 is concentrically housed in idler 250. Idler 250 and spacer 251 are rotatably mounted, optionally fixedly mounted, to and laterally inside of handle arm 202A.

Thus, cable 240 extends in a first direction of extension to idler 250. Cable 240 wraps around a portion of the outer circumferential surface of idler 250, and continues to extend along a second direction of extension, generally perpendicularly toward chute rotation body 392A, and is attached thereto as previously described.

Accordingly, to rotate discharge chute assembly 391 in a first direction, the user rotates chute rotation handle 230 in a first direction, which rotates idler 233 in a first direction. Upon so doing, relatively more of first cable segment 240A is wound upon idler 233 and relatively more of second cable segment 240B is unwound therefrom. Correspondingly, some of first cable segment 240A unwinds from rotation body 392A and some of second cable segment 240B winds further upon the rotation body, which rotates chute assembly 391 in the first direction.

Then to rotate discharge chute assembly 391 in a second, opposite direction, the user rotates chute rotation handle 230 in a second, opposite direction, which rotates idler 233 in a second, opposite direction. Upon so doing, relatively more of second cable segment 240B is wound upon idler 233 and relatively more of first cable segment 240A is unwound therefrom. Correspondingly, some of second cable segment 240B unwinds from rotation body 392A and some of first cable segment 240A winds further upon the rotation body, which rotates chute assembly 391 in the second direction.

Snow blower 1 preferably includes various safety mechanisms, namely various electronically switchable safety mechanisms. Components of these electronically switchable safety mechanisms include, pivot bracket 260, spring 261, PTO safety switch 964A, neutral safety switch 964B, switch extension 964C, draw rod guide-plate 982, neutral switch ramp-plate 984.

These safety mechanisms are adapted and configured to, for example, disable various components of snow blower 1 upon an open circuit condition within the electric circuit of the corresponding device. Specifically, certain switches in the electrical system must be actuated, so as to close the corresponding circuit, in order for e.g. starter mechanism 108 to operate and thus start the internal combustion engine, to enable the PTO system to operate, and/or others.

Referring now to FIGS. 4 and 5, pivot bracket 260 has first and second ends, an upper surface and a lower surface. The upper surface of pivot bracket faces toward panel mounting bracket 203B and operably interfaces PTO safety switch 964A.

The first end of pivot bracket 260 includes a tab or other protuberance which extends outwardly therefrom. This tab is captured in and rockingly housed in an aperture which extends through panel mounting bracket 203B. Thus, through the communication between the first end tab and the panel mounting bracket 203B, pivot bracket 260 is pivotally attached to panel mounting bracket 203B.

The second end of pivot bracket 260 is distal handle arm 202A and has a bore extending therethrough. The second end bore of the pivot bracket is adapted and configured to attach an end of spring 261 to pivot bracket 260.

Spring 261 extends between and connects pivot bracket 260 and the lower cross member of PTO bail 211. The first end of spring 261 extends through the second end bore of pivot bracket 260. The second end of spring 261 wraps at least partially around the circumference of, and is captured by, a circumferential groove which extends into and about the outer circumferential surface of the lower cross member of PTO bail 211.

Accordingly, when the U-shaped member of PTO bail 211 is pivoted forward and down, the bail lower cross member is relatively nearer pivot bracket 260, whereby spring 261 is generally in a relaxed, resting, state and pivot bracket 260 is pivoted outwardly away from panel mounting bracket 203A. When the U-shaped member of PTO bail 211 is pivoted upwardly and back, the bail lower cross member is relatively further from pivot bracket 260, whereby spring 261 is generally extended and in a state of tension. The tensile force of spring 261 is transmitted to pivot bracket 260 which biases the bracket 260 toward panel mounting bracket 203A, which communicates with PTO safety switch 964A.

PTO safety switch 964A is preferably a plunger-type switch. In other words, PTO safety switch 964A includes a switch body that houses the switching mechanism and a plunger which extends outwardly from the switch body and functions as the actuation mechanism of the switch, and with biases between a first position and a second position.

In the first position, the plunger is depressed inwardly toward, at least partially into, the switch body, whereby the switch is closed and the PTO system can freely operate, if the remainder of the circuit is also closed. In the second position, the plunger is biased outwardly, extending at least partially from the switch body, whereby the switch is open and the PTO system will not operate. In other words, when the remainder of the PTO electrical circuit is closed, if a user desired to use the PTO system and thus auger assembly 300, the user must pivot the PTO bail upwardly and back to depress the plunger of PTO safety switch 964A by way of pivot bracket 260 and spring 261.

Neutral safety switch 964B is preferably a plunger-type switch which electrically communicates with the electric starter circuit. Namely, neutral safety switch 964 includes a switch body that houses the switching mechanism and a plunger which extends outwardly from the switch body and functions as the actuation mechanism of the switch and with biases between a first position and a second position.

In the first position, the plunger is depressed inwardly toward, at least partially into, the switch body, whereby the switch is closed and the starter motor can be energized, if the remainder of the circuit is also closed. In the second position, the plunger is biased outwardly, extending at least partially from the switch body, whereby the switch is open and the starter motor can not be energized. In other words, when the remainder of the electrical starting mechanism circuit is closed, if a user desired to start the internal combustion engine, the user must ensure that the plunger of neutral safety switch 964B is depressed.

The plunger of neutral safety switch 964B is depressed when various cooperating components are suitably aligned therewith. Namely, the plunger of neutral safety switch 964B is depressed when various ones of switch extension 964C, draw rod guide-plate 982, and neutral switch ramp-plate 984 are suitably positioned with other ones of switch extension 964C, draw rod guide-plate 982, neutral switch ramp-plate 984, and neutral safety switch 964B.

Switch extension 964C is a generally rigid, cylindrical member which is coaxially aligned with and connected to the plunger of neutral safety switch 964B. Switch extension 964C has a first end which interfaces with the safety switch and a second end which defines a generally conical, optionally hemispherical, optionally otherwise tapering, terminal end portion. Switch extension 964C is adapted and configured to transmit forces therethrough, and to the plunger of neutral safety switch 964B. In other words, switch extension 964C effectively generally elongates the operable length of the safety switch plunger.

Draw rod guide-plate 982 is, for example, an angle bracket which slidingly communicates with drive control upper draw rod 220. A first portion of draw rod guide-plate 982 interfaces with and is connected to the lower surface of panel mounting bracket 203B. A second portion of draw rod guide-plate 982 extends perpendicularly away from the first guide-plate portion and has an inwardly facing surface and an outwardly facing surface.

The inwardly facing surface of guide-plate 982 slidingly interfaces with a portion of the outer circumferential surface of upper draw rod 220, which generally faces handle arm 201A. Thus, draw rod guide-plate 982 offers lateral support to upper draw rod 220, generally mitigating non-desired lateral movement thereof, in the direction toward handle arm 201A.

Neutral switch ramp-plate 984 has first and second end portions, and a medial portion, and is connected to the outer surface of upper draw rod 220, by way of e.g. weldments, mechanical fasteners, adhesive, and/or otherwise. The first and second ends of neutral switch ramp-plate 984 are generally planar and generally coplanar with each other. The lower surfaces of the ramp-plate first and second ends interface with a portion of the outer circumferential surface of upper draw rod 220, which generally faces handle arm 202A.

The medial potion of neutral ramp-plate 984 defines two generally ramped surfaces. The ramped surfaces each originates at a respective point of intersection with ones of the ramp-plate first and second ends. From the respective points of intersection, each of the ramped surfaces generally angularly extends outwardly from the respective point of intersection with ones of the ramp-plate first and second ends, toward each other, and terminate at a locus of joinder between the ramped surfaces. Thus, the surface of neutral ramp-plate 984 from which the medial portion extends generally defines a convex outer surface.

Accordingly, in the complete assemblage, the first and second ends of neutral ramp-plate 984 are attached to upper draw rod 220 and the medial portion of the ramp-plate extends outwardly from upper draw rod 220, toward handle arm 202A. And since neutral ramp-plate 984 is attached to upper draw rod 220, the ramp-plated travels in unison with the draw rod, whereby user input to handlebar 210 which translates to generally linear motion of upper draw rod 220 correspondingly translates to generally linear motion of neutral ramp-plate 984.

The second, generally tapered, end portion of switch extension 964C slidably interfaces with the convex outer surface of neutral ramp-plate 984. Neutral safety switch 964B provides a biasing force, transmitted through the switch plunger, to switch extension 964C which biases the extension outwardly in the direction of neutral ramp-plate 984, whereby the second end of switch extension 964C is generally biasingly held in an interfacing relationship with the convex outer surface of neutral ramp-plate 984, irrespective of which particular portion of the ramp-plate is in actually interfacing communication with the extension 964C.

However, when switch extension 964C communicates with, for example, the first or second ends of neutral ramp-plate 984 or with portions of the ramped surfaces which are adjacent the first and second ends of the ramp-plate, the plunger of neutral safely switch 964B is in a generally outwardly extended position. And when switch extension 964C communicates with, for example, the apex of the medial portion of neutral ramp-plate 984 or with portions adjacent the intersection of the ramped surfaces, the plunger of neutral safely switch 964B is in a generally depressed position, whereby the switch is closed.

Switch extension 964C generally communicates with the apex of the medial portion of neutral ramp-plate 984 when handlebar 210 is in a resting, neutral, state. Thus, if handlebar 210 is pivoted sufficiently far forward or backward, switch extension 964C communicates with e.g. the first or second ends of neutral ramp-plate 984, whereby the switch plunger is outwardly extended, the starting circuit is open, the starter motor can not be energized, and the internal combustion engine can not be started by way of the electrical starting mechanism.

Panel assembly 590 includes panel housing 591A, panel lower cover 591B, ignition switch 961, PTO switch 962, and headlight switch 963. Panel housing 591A includes an upper wall, and a plurality of sidewalls. The panel housing upper wall is generally planar, has a plurality of apertures which extend therethrough, and outer perimeter edges. The sidewalls extend generally perpendicularly downwardly from the outer perimeter edges of the panel housing top wall. Respective ones of the sidewalls are connected to each other, at interfacing edge surfaces, whereby the lower surface of the upper wall and the inwardly facing surfaces of the sidewalls generally define an outer perimeter of a void, e.g. cavity, within panel housing 591A.

As desired, each of the lateral-most sidewalls of panel housing 591A includes a slot which extends thereinto, toward the panel housing upper wall. The opening dimensions of such slots corresponds to respective outside dimensions of mounting bracket 203B, whereby the sidewall slots sliding accept panel mounting bracket 203B thereinto. Accordingly, the panel housing 591A can be mounted to mounting bracket 203B, by way of e.g. bolts extending though aligned bores passing through the respective structures, with the mounting bracket 203B housed in the sidewall slots and generally extending through the panel housing cavity.

Panel lower cover 591B includes a back wall and a plurality of sidewalls, e.g. three or more sidewalls. Panel lower cover 591B is securingly attached to panel housing 591A by way of, for example, bolts, corresponding snap-lock structures, screws, rivets, and/or others.

The panel housing back wall is generally planar and defines a generally continuous surface and outer perimeter edges. The sidewalls extend generally perpendicularly upwardly from the outer perimeter edges of the panel housing top wall. Respective ones of the sidewalls are connected to each other, at interfacing edge surfaces.

Panel lower cover 591B has an outer perimeter which is generally smaller than the inner perimeter defined by panel housing 591A. Namely, panel housing 591A is adapted and configured to receive at least part of lower cover 591B thereinto, into the panel housing cavity. Preferably, the overall dimensions and other properties and characteristics of panel housing 591A and lower cover 591B enable the assemblage of the two components to suitably separate and provide an adequate barrier between the panel housing cavity and the ambient. In other words, the assemblage of panel housing 591A and lower cover 591B provide a substantially weatherproof environment inside the cavity enclosure defined thereby.

Ignition switch 961, PTO switch 962, and headlight switch 963 are each housed in a respective aperture, sized and configured for the particular switch, which extends through the housing upper wall. Namely, each of ignition switch 961, PTO switch 962, and headlight switch 963, extends through the panel housing upper wall, into the panel housing cavity, and is snap lockingly, frictionally, boltingly, and/or otherwise suitably, secured to panel housing 591A.

Figure 12:
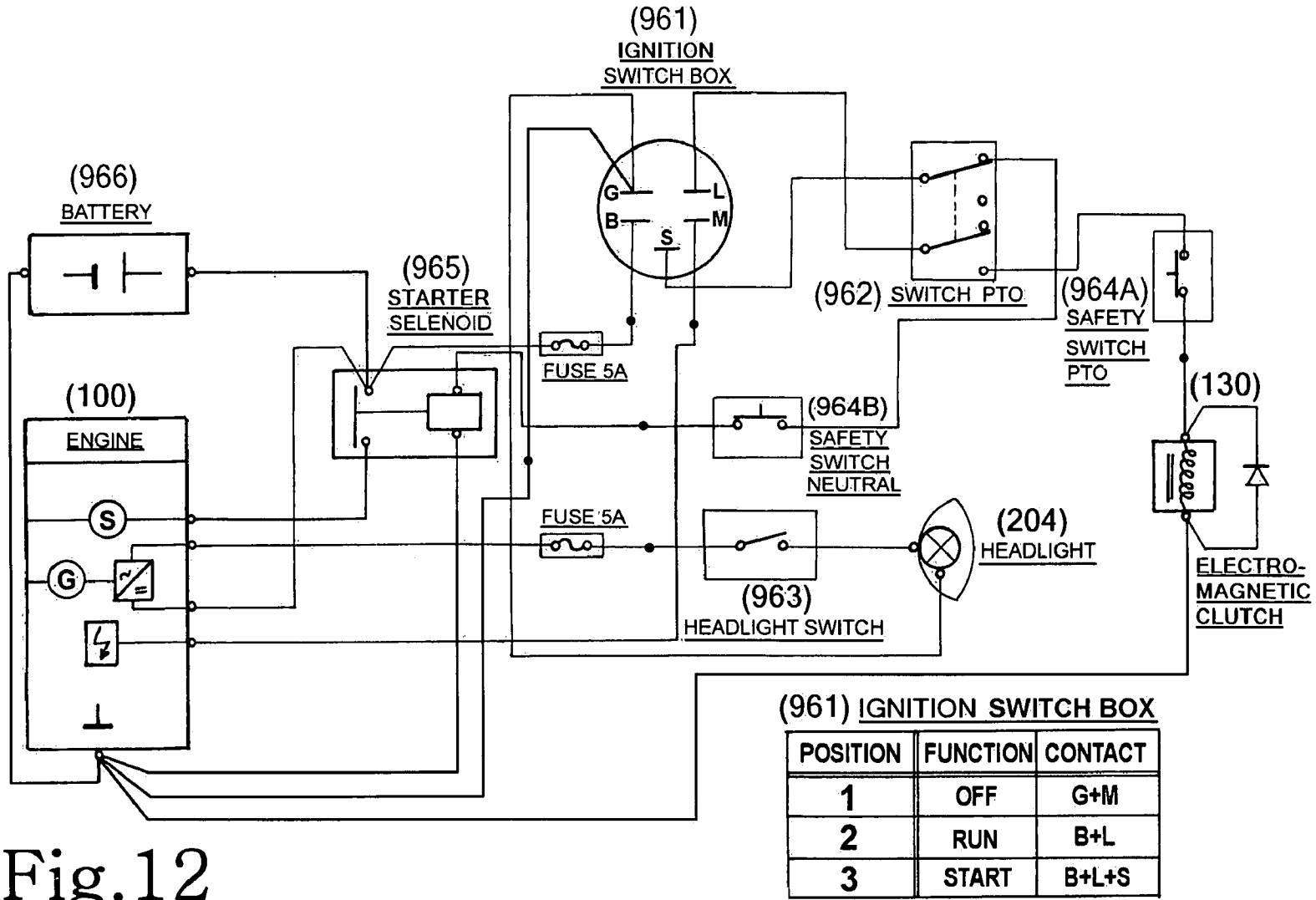
FIG. 12 shows a schematic diagram of exemplary electrical circuits of snow blowers of the invention.

Referring now to FIG. 12, various electronic circuits enable a user to control various corresponding electrical and/or electromechanical components of snow blower 1, as desired. Battery 966 (FIGS. 12 and 4) provides electrical power to various circuits and components of snow blower 1. Ignition switch 961 provides the primary switching functions for the electrical components of snow blower 1.

Ignition switch 961 is in electrical communication with at least parts of engine/prime mover 100, electromagnetic clutch 130, headlight 204, PTO switch 962, headlight switch 963, PTO safety switch 964A, safety neutral switch 964B, starter solenoid 965, and battery 966. Headlight switch 963 is in electrical communication with headlight 204, ignition switch 961, battery 966, and/or others. PTO switch 962 is in electrical communication with ignition switch 961, PTO safety switch 964A, electromagnetic clutch 130, battery 966, and/or others.

Referring now to FIGS. 6, 7, 8, 9A, and 9B, snow blower 1 enables a user to as desired, selectively lock the first and second wheel assemblies 20, into rotational unison with respect to each other.

Each of wheel assemblies 20 includes wheel 21A, tire 21B, and various pieces of mounting hardware. Wheel 21A is preferably a steel, optionally aluminum, optionally other metallic, type-wheel. Wheel 21A further includes a hub mounting structure, at the inwardly facing, medial portion thereof. A through bore extends axially through the hub mounting structure and defines an inner circumferential surface. A keyway extends into this inner circumferential surface, and along the length thereof. The keyway is adapted and configured to accept key 24 therein, which mechanically locks the hub mounting structure and thus wheel 21A to axle shaft 15A. In addition, washers 25, 26, ring 17, one or more threaded nuts, cover 28, and/or other suitable hardware, removably attach wheel assembly 20 to axle shaft 15A and/or 15B.

The inwardly facing end of the hub mounting structure, e.g. the end which faces transaxle assembly 10, defines an end surface with alternating projections extending therefrom and recesses extending thereinto. The projections and recesses of the hub mounting structure end is adapted and configured to cooperatively interface with corresponding structure of components of selectable lock assembly 780.

Selectable lock assembly 780 includes tie shaft 800, bracket 801, base plate 802, washer 803, pin 804, pivot pins 804A, 804B, locking arm 820, protuberance 821, pivot arm 825, spring 826, pedal 830A, 830B, drive gear 838, driven hub gear 840, interlock hub 842 and cover 850.

Tie shaft 800 is an elongate, rigid, generally cylindrical member, which extends through chassis 7, generally between the first and second wheel assemblies. Tie shaft 800 is adapted and configured to rotate about an axis of rotation, and to pivotably and/or otherwise move or translate which enables various components of selectable lock assembly 780 to selectively cooperate with other, corresponding, components of selectable lock assembly 780

Each end of tie shaft 800 includes a portion which defines a generally lesser diameter than the remainder of shaft 800. In other words, each end of tie shaft 800 is a generally stepped-down, shoulder portion. A bore extends radially into each end of tie shaft 800, adjacent the respective shoulder portions.

Bracket 801 is an e.g. L-shaped bracket which movably houses tie shaft 800 and movably attaches the tie shaft to running gear assembly 5. Namely, the generally horizontal portion of bracket 801 is attached to an upper surface of an outer end of transaxle assembly 10, optionally to frame rail 7F, optionally elsewhere on chassis 7. The generally vertical portion of bracket 801 extends upwardly from the outermost later edge of the horizontal portion, and has an elongate aperture which extends through the thickness of the generally vertical portion. The shape, configuration, and/or other characteristics of the elongate aperture correspond to the desired travel path of tie shaft 800.

Base plate 802 is an e.g. elongate plate member which has a lower flange extending generally perpendicularly outwardly from a lower portion thereof. Base plate 802 movably houses tie shaft 800 and movably attaches the tie shaft to running gear assembly 5. Namely, the lower flange of base plate 802 is attached to an upper surface of an outer end, opposite the end to which bracket 801 is attached, of running gear assembly 5. Optionally base plate 802 is attached to frame rail 7F, optionally elsewhere on chassis 7. The generally vertical oriented plate portion of base plate 802 extends upwardly from the lower flange, and has an elongate aperture which extends through the thickness of the generally vertical portion. The shape, configuration, and/or other characteristics of the elongate aperture correspond to the desire travel path of tie shaft 800.

Base plate 802 defines an inwardly facing surface and an outwardly facing surface. The inwardly facing surface of base plate 802 faces toward chassis 7 and the outwardly facing surface of base plate 802 faces outwardly away from chassis 7. Cover mounting structure, such as, for example, first and second elongate screw bosses extend outwardly from the outwardly facing surface of base plate 802.

Although tie shaft 800 moves generally vertically within bracket 801 and base plate 802, as enabled at least partially by the respective elongate apertures of the bracket and plate, tie shaft 800 is held generally laterally static with respect thereto. Namely, pins 804 are inserted into the bores adjacent the ends of tie shaft 800. Pins 804 generally laterally restrain washers 803, which are mounted inwardly of bracket 801 and base plate 802. The interfacing relationship between washers 803 and the inwardly facing surfaces of bracket 801 and base plate 802, generally mechanically prevent non-desired lateral movement of tie shaft 800.

Pivot pins 805A and 805B extend outwardly from the inward facing surface of base plate 802, e.g. toward chassis 7. Pivot pins 805A and 805B are adapted and configured to pivotably house locking arm 820 and pivot arm 825 thereon, respectively.

Lock arm 820 is an elongate, generally plate like member with an upper edge, a lower edge, a pivot bore, and a shaft bore. The shaft bore extends through the thickness of lock arm 820, through generally a medial portion thereof. Tie shaft 800 extends through the shaft bore of lock arm 820, whereby the shaft is rotatably housed in lock arm 820. As desired, tie shaft 800 is rotatably housed in directly in lock arm 820, optionally separated therefrom by e.g. suitable spacers, bushings, bearings, and/or other suitable interfacing members.

The pivot bore of lock arm 820 extends through the thickness of lock arm 820, adjacent the forward most end of the arm. The pivot bore of arm 820 pivotably rides upon pivot pin 804A, which generally defines an axis of pivotation of the arm.

Protuberance 821 is attached to the upper edge of lock arm 820, adjacent the rearward most end of the arm. Protuberance 821 is adapted and configured to attach a first end of spring 826 thereto.

Pivot arm 825 is an elongate, generally plate like member with an upper surface, a lower surface, front and back ends, and a pivot bore. The front end and the upper surface of the arm 825 generally define first 827 and second 828 ramped surfaces, with are adapted and configured to interface, separately, with the lower edge 829 surface of lock arm 820.

The pivot bore of pivot arm 825 extends through the thickness of pivot arm 825, adjacent a medial portion of the arm. The pivot bore of arm 825 pivotably rides upon pivot pin 804B, which generally defines an axis of pivotation of the arm.

Figure 9A:
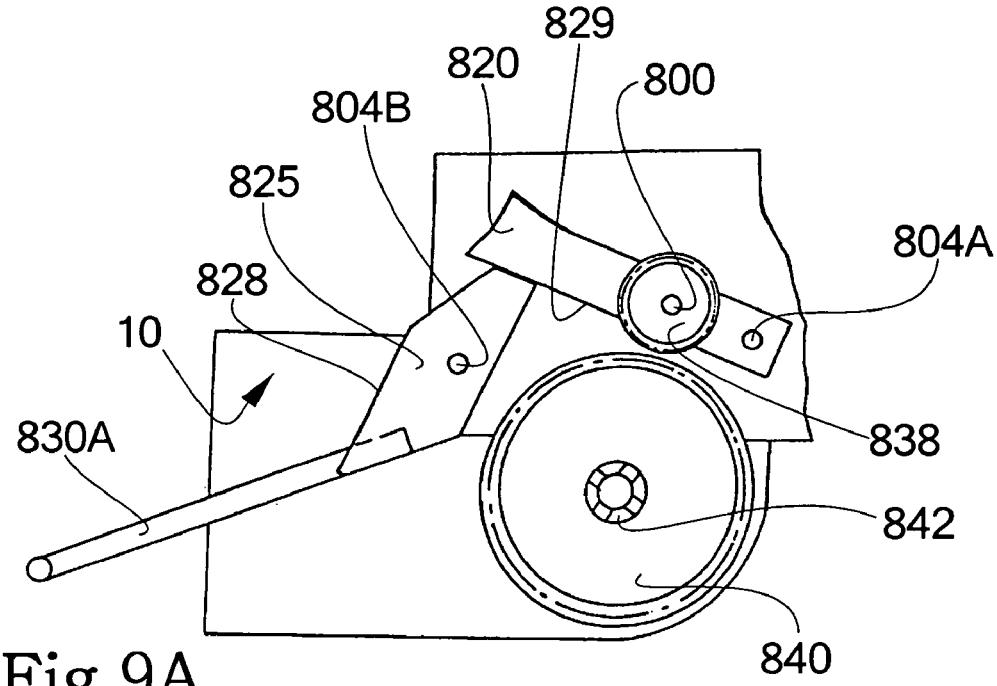
FIG. 9A shows a side elevation of the selectable lock assembly of FIG. 7 in a wheel unlocked position.

The pivot position of pivot arm 825 determines which of the first 827 and second 828 ramped surfaces of arm 825 interfaces the lower surface 829 of lock arm 820. Namely, when pivot arm 825 is pivoted downwardly, so that the front end thereof is relatively higher, the first ramped surface 827, proximate the end of arm 825, interfaces the lower surface 829 of lock arm 820, as illustrated in FIG. 9A. As the first ramped surface 827 of pivot arm 825 interfaces lock arm 820, lock arm 820 is pushed generally upwardly and forwardly, pivoting about pivot pin 804A.

Figure 9B:
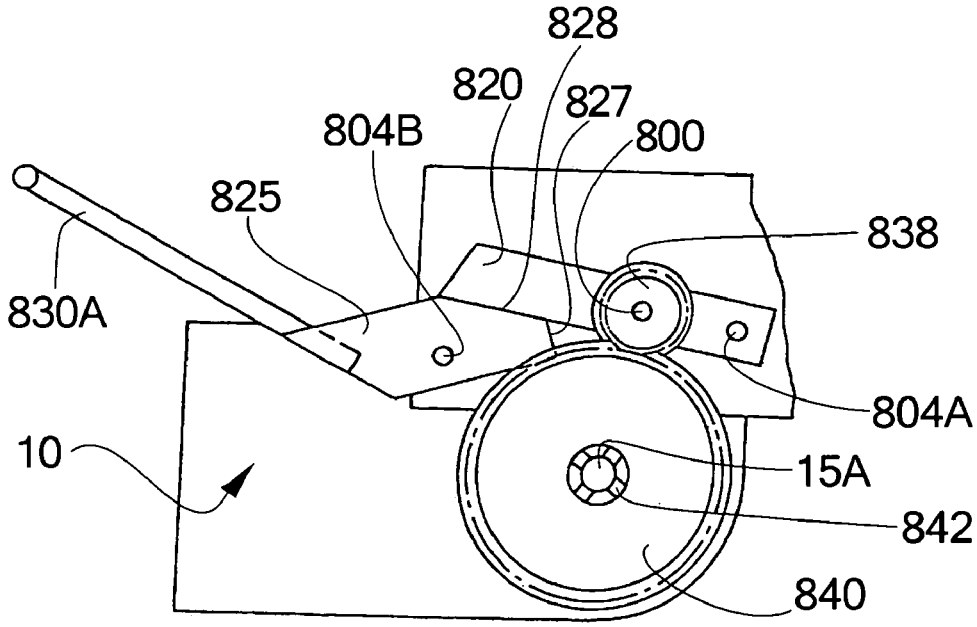
FIG. 9B shows a side elevation of the selectable lock assembly of FIG. 7 in a wheel locked position.

When pivot arm 825 is pivoted relatively less far, so that the front end thereof is relatively lower, second ramped surface 828, which angularly extends upwardly and back from first ramp surface 827 toward and about the pivot bore, the second ramped surface interfaces with lower surface 829 of lock arm 820, as illustrated in FIG. 9B. As the second ramped surface of pivot arm 825 interfaces lock arm 820, lock arm 820 can be pivoted generally downwardly and back, about pivot pin 804A.

Spring 826 extends between and connects lock arm 820 and chassis 7. Namely, a first end of spring 826 is attached to protuberance 821 and the second end of spring 826 is attached to a chassis lower flange. Spring 826 is a tension spring whereby the spring urges lock arm 820 downwardly and back, pivotably about pivot pin 804A.

Figure 7:
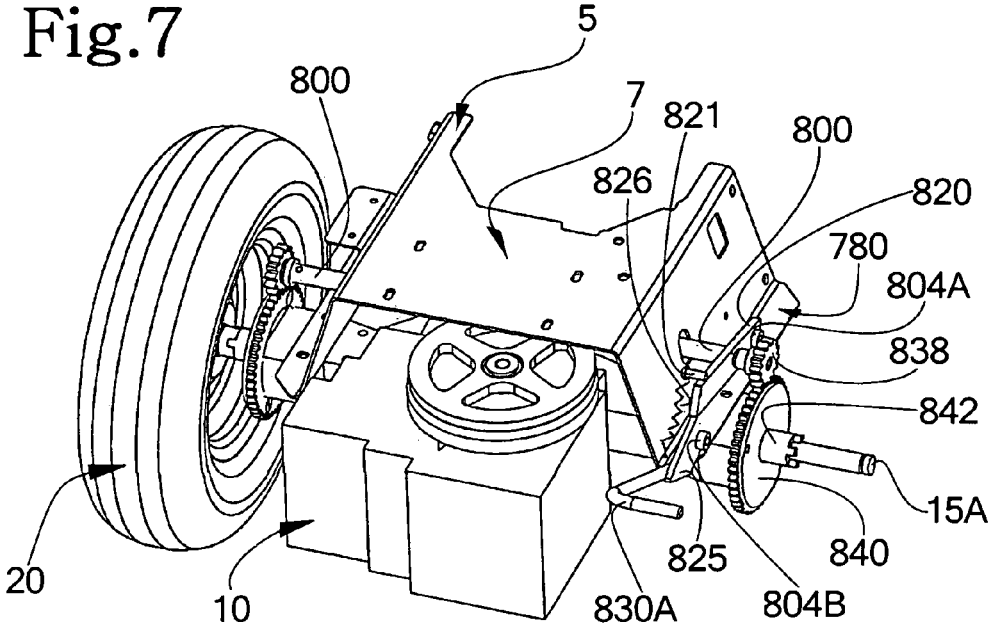
FIG. 7 shows a pictorial view of parts of the running gear assembly, with one wheel assembly and other components removed, including a first embodiment of selectable lock assemblies of the invention.
Figure 8:
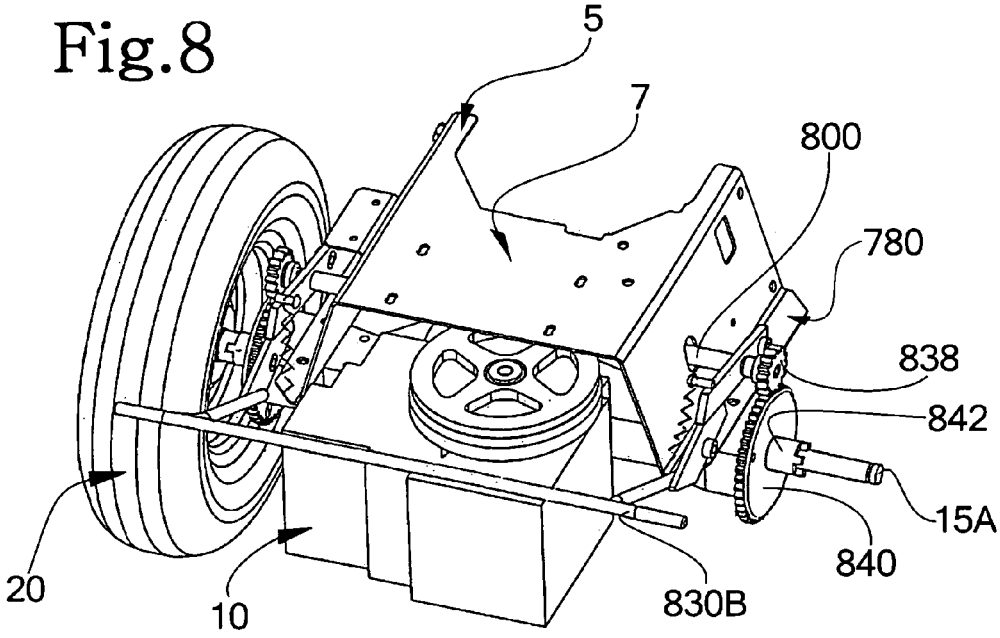
FIG. 8 shows a pictorial view of parts of the running gear assembly, with one wheel assembly and other components removed, including a second embodiment of selectable lock assemblies of the invention.

In some embodiments, such as that illustrated in FIG. 7, snow blower 1 includes one base plate 802 and set of corresponding, cooperating components (base plate 802 is removed in FIG. 7 to show various corresponding components). In other embodiments, such as the one exemplarily illustrated in FIG. 8, snow blower 1 optionally includes two base plates 802 and two sets of corresponding, cooperating components, e.g. communicating with each of the two wheel assemblies 20 (base plates 802 is removed in FIG. 8 to show various corresponding components).

In embodiments which include a single base plate 802, the assemblage can include a single actuating mechanism, namely a single pedal 830A. In embodiments which include two base plates 802, the assemblage includes first and second actuating mechanism, namely two-pedal assembly 830B, or a single actuating mechanism which actuates both base plate lever assemblies. Regardless of the particular implementation, each pedal 830A, 830B includes an elongate member which attaches the pedal to the back end of the respective pivot arm(s) 825.

Optionally, snow blower 1 can include a cable actuation mechanism in addition to, or in lieu of, pedals 830A, 830B. Such mechanism can include, for example first and second cables, one which pulls the back end of pivot plate 825 upwardly, the other which pulls the back end of pivot plate 825 downwardly, so as to pivot the pivot plate, as desired, about pivot pin 804B. Such cable actuation mechanism can be manipulated by the hand of a user, and the end of such cable actuation mechanism can be mounted to e.g. panel assembly 590.

Drive gears 838 have toothed outer circumferential surfaces and are fixedly attached to respective ends of tie shaft 800, by way of e.g. press fit or other suitable attachment to lesser diameter, shouldered, end portions of the shaft. Thus, drive gears 838 rotate in unison with tie shaft 800 and/or vertically, pivotably, or otherwise movingly translate in unison with the tie shaft.

Driven hub gears 840 are fixedly attached to respective ones of axle shafts 15A, 15B, by way of e.g. press fit, corresponding keys and keyways, corresponding splined surfaces, setscrews, and/or other suitable means of attachment. In other words, ones of driven hub gears 840 rotate in unison with respective ones of axle shafts 15A, 15B.

Driven hub gears 840 each have an inwardly facing surface, an outwardly facing surface, and a toothed outer circumferential surface which is adapted and configured to cooperatively interface with the toothed outer surface of drive gear 838. The inwardly facing surface of driven hub gear 840 faces chassis 7 and the outwardly facing surface of gear 840 faces wheel assembly 20.

The relationship between drive and driven hub gears 838 and 840 generally defines two distinct operating conditions of selectable lock assembly 780. In the first, unlocked condition, the drive and driven hub gears 838 and 840 are generally radially spaced from each other and do not interface. In the second, locked, condition, the drive and driven hub gears 838 and 840 toothedly and operably interface with each other, whereby drive gear 838 can generally rotatably drive driven hub gear 840, and vise versa.

Interlock hub 842 extends generally axially away from a medial portion of the outwardly facing surface of driven hub gear 840, and rotates in unison therewith. Interlock hub 842 is adapted and configured to interface and operably couple with the hub mounting structure of wheel 21A.

Namely, interlock hub 842 has an end surface with alternating right-angle projections extending therefrom and right-angle recesses extending thereinto. The projections and recesses of interlock hub 842 mechanically interlock with corresponding recesses and projections of wheel 21A, thereby lockingly coupling driven hub gear 840 with wheel assembly 20.

As desired, the assemblage further includes cover 850. Cover 850 envelopes, shields, covers, and/or otherwise at least partially encapsulates, various components of selectable lock assembly 780, such as e.g. drive and driven hub gears 838, 840, and/or others. Screws and/or bolts extend through bores of cover 850, and threadedly insert into the screw bosses of base plate 802, generally affixing the cover thereto.

Accordingly, as desired, to actuate the mechanism into the first unlocked condition, a user presses downwardly on e.g. pedal 830A, which pivots the front end of pivot arm 825 about pivot pin 804B, upwardly and back. Namely, this pivotal motion of pivot arm 825 slides second ramped surface 828 of arm 825 out from under bottom surface 829 of lock arm 820, which pivots lock arm 820 about pivot pin 804A, upwardly and forward, until first ramped surface 827 of pivot arm 825 interfaces lower surface 829 of lock arm 820. The rearwardly directed tensile biasing force provided by spring 826 generally holds the locker and pivot arms 820, 825 in this condition, with first ramped surface 827 interfacing lower surface 829 of lock arm 820 (FIG. 9A), thus raising gear 838 out of engagement with gear 840.

In this unlocked condition, the drive and driven hub gears 838 and 840 are generally radially spaced from each other and do not interface. Correspondingly, wheel assemblies 20 are generally not locked in rotational unison with each other, whereby the wheel assemblies are generally free to rotate with respect to each other as permitted by differential mechanism assembly 14.

To actuate the wheel lock mechanism into the second, locked condition, a user pulls upwardly on e.g. pedal 830A, which pivots the front end of pivot arm 825 about pivot pin 804B, downwardly and foreword. Namely, this pivotal motion of pivot arm 825 slides first ramped surface 827 of arm 825 forwardly out from under bottom surface 829 of lock arm 820, which enables spring 826 to draw lock arm 820 about pivot pin 804A, downwardly and back, until second ramped surface 828 of pivot arm 825 interfaces lower surface 829 of lock arm 820. The rearwardly directed tensile biasing force provided by spring 826 generally holds lock arm 820 and pivot arm 825 in this condition, with second ramped surface 828 of the pivot arm 825 interfacing the lower surface 829 of lock arm 820.

In the locked condition, the drive and driven hub gears 838 and 840 toothedly and operably interface with each other, whereby drive gear 838 can generally rotatably drive driven hub gear 840, and vise versa. Correspondingly, wheel assemblies 20 are generally locked in rotational unison with each other, whereby torque applied to one wheel assembly 20 is necessarily applied to the other wheel assembly 20, as transmitted through a first wheel assembly, through a first driven hub gear 840 and drive gear 838, thence through tie shaft 800 to the second drive gear 838, through the second driven hub gear 840, and ultimately to the second wheel assembly 20.

In other words, in the locked condition, wheel assemblies 20 are locked into rotational unison with each other, by way of selectable lock assembly 780, irrespective of any force differentiation between first and second axle shafts 15A, 15B, realized through differential mechanism assembly 14.

Preferably, various components of snow blower 1 are suitably protected from non-desired forces and/or loads. Exemplary of such protection mechanisms are readily replaceable and relatively inexpensive components such as shear bolts, shear pins, and/or others, which will break under strain, load, or other force before mechanical damage is realized at the protected component.

Pivotable, rotatable, and/or other parts of snow blower 1, including, but not limited to, various one of the idlers, pulleys, handles, and/or others, include bearings, spacers, bushings, and/or other cooperating components, which are, for example, housed in respective axial bores, recesses, or other suitably receiving structures, which enable such pivotable, rotatable, and/or other parts to suitably move e.g. pivot, rotate, or otherwise move relative to other parts, as desired and for the intended use life of the respective component.

Preferably, snow blower 1 is made of materials which resist corrosion, and are suitably strong and durable for normal extended use. Those skilled in the art are well aware of certain metallic and non-metallic materials which possess such desirable qualities, and appropriate methods of forming such materials.

Appropriate metallic materials for components of snow blower 1 include, but are not limited to, anodized aluminum, aluminum, steel, stainless steel, titanium, magnesium, brass, and their respective alloys. Common industry methods of forming such metallic materials include casting, forging, shearing, bending, machining, riveting, welding, powdered metal processing, extruding, molding, and others.

Non-metallic materials suitable for components of snow blower 1 such as ones of various idlers 80A, 80B, 233, 250, 421, various covers, shields, guards, and/or others, are various polymeric compounds, such as for example and without limitation, various of the polyolefins, such as a variety of the polyethylenes, e.g. high density polyethylene, or polypropylenes. There can also be mentioned as examples such polymers as polyvinyl chloride and chlorinated polyvinyl chloride copolymers, various of the polyamides, polycarbonates, and others.

For any polymeric material employed in structures of the invention, any conventional additive package can be included such as, for example and without limitation, slip agents, anti-block agents, release agents, anti-oxidants, fillers, and plasticizers, to control e.g. processing of the polymeric material as well as to stabilize and/or otherwise control the properties of the finished processed product, also to control hardness, bending resistance, and the like.

Common industry methods of forming such polymeric compounds will suffice to form non-metallic components of snow blower 1. Exemplary, but not limiting, of such processes are the various commonly-known plastics converting processes.

Snow blower 1 is preferably manufactured as individual components, and the individual components assembled as sub-assemblies, including but not limited to, running gear assembly 5, prime mover 100, handle assembly 200, auger assembly 300, discharge chute assembly 391, selectable lock assembly 780, and others. Each of the aforementioned sub-assemblies is then assembled to respective other ones of the sub-assemblies to develop snow blower 1.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A walk-behind snow blower apparatus, comprising:

(a) a chassis;

(b) an axle assembly communicating with said chassis;

(c) a hydrostatic drive assembly drivingly communicating with said axle assembly;

(d) a control handle, movement of said walk-behind snow blower apparatus being controlled by an operator through said handle; and (e) a user input device controllingly attached to said hydrostatic drive assembly, and said user input device being a handle which effects control movements by pivoting said handle about an axis of pivotation, said walk-behind snow blower apparatus being movable in a first, forward direction of travel, or in a second, opposite and reverse direction of travel, at speeds which are continuously variable between a first relatively slower speed of travel and a second substantially faster speed of travel, and multiple intermediate speeds between the first and second speeds, said user input device and said hydrostatic drive assembly, in combination, being adapted and configured to adaptively control said walk-behind snow blower apparatus based on a user input applied to said user input device which continuously variably and adaptively influences and/or controls the real time speed of travel of said walk-behind snow blower apparatus.

2. A walk-behind snow blower as in claim 1 wherein said user input device controls both direction of travel and the continuously variable speed of travel.

3. A walk-behind snow blower as in claim 1 wherein when said handle is urged in a first direction, said walk-behind snow blower apparatus correspondingly travels in a such first direction and when said pivotably handle is urged in a second, opposite direction, said walk-behind snow blower apparatus correspondingly travels in a such second, opposite direction.

4. A walk-behind snow blower as in claim 1 wherein said handle has a resting, neutral position, a maximum forward position, and a maximum reverse position, said handle being continuously variably movable between said maximum forward position and said maximum reverse position.

5. A walk-behind snow blower as in claim 4 wherein the magnitude of the distance by which said handle is displaced from the resting, neutral position corresponds to the magnitude of the speed at which said walk-behind snow blower travels whereby pivotation of said handle a relatively greater distance from such resting, neutral position corresponds to a correspondingly greater rate of speed at which said walk-behind snow blower travels.

6. A walk-behind snow blower apparatus, comprising:

(a) a chassis;

(b) an axle assembly communicating with said chassis;

(c) a hydrostatic drive assembly drivingly communicating with said axle assembly;

(d) a control handle, movement of said walk-behind snow blower apparatus being controlled by an operator through said handle; and (e) a user input device controllingly attached to said hydrostatic drive assembly, said user input device is a handle which effects control movements by pivoting said handle about an axis of pivotation, said handle having a resting, neutral position, and a maximum forward position, and said handle being continuously variably movable between said resting, neutral position and said maximum forward position, and said handle controls direction of travel and the continuously variable speed of travel, said walk-behind snow blower apparatus being movable in a first, forward direction of travel, or in a second, opposite and reverse direction of travel, at speeds which are continuously variable between a first relatively slower speed of travel and a second substantially faster speed of travel, and multiple intermediate speeds between the first and second speeds, said user input device and said hydrostatic drive assembly, in combination, being adapted and configured to adaptively control said walk-behind snow blower apparatus based on a user input applied to said user input device which continuously variably and adaptively influences and/or controls the real time speed of travel of said walk-behind snow blower apparatus, and wherein the magnitude of the distance by which said handle is displaced from the resting, neutral position corresponds to the magnitude of the speed at which said walk-behind snow blower travels whereby pivotation of said handle a relatively greater distance from such resting, neutral position corresponds to a correspondingly greater rate of speed at which said walk-behind snow blower travels.

7. A walk-behind snow blower apparatus, comprising:

(a) a chassis;

(b) an axle assembly communicating with said chassis;

(c) a hydrostatic drive assembly drivingly communicating with said axle assembly;

(d) a control handle, movement of said walk-behind snow blower apparatus being controlled by an operator through said handle; and (e) a user input device controllingly attached to said hydrostatic drive assembly, and said user input device being a handle which effects control movements by pivoting said handle about an axis of pivotation, said walk-behind snow blower apparatus being movable in a first, forward direction of travel at speeds which are continuously variable between a first relatively slower speed of travel and a second substantially faster speed of travel, and multiple intermediate speeds between the first and second speeds, said user input device and said hydrostatic drive assembly, in combination, being adapted and configured to adaptively control said walk-behind snow blower apparatus based on a user input applied to said user input device which continuously variably and adaptively influences and/or controls the real time speed of travel of said walk-behind snow blower apparatus.

8. The walk-behind snow blower apparatus of claim 7 wherein said handle has a resting, neutral position, and a maximum forward position, and said handle being continuously variably movable between said resting, neutral position and said maximum forward position.

9. The walk-behind snow blower apparatus of claim 8 wherein the magnitude of the distance by which said handle is displaced from said resting, neutral position corresponds to the magnitude of the speed at which said walk-behind snow blower travels whereby pivotation of said handle a relatively greater distance from said resting, neutral position corresponds to a correspondingly greater rate of speed at which said walk-behind snow blower travels.

10. A walk-behind snow blower apparatus, comprising:

(a) a chassis;

(b) an axle assembly communicating with said chassis;

(c) a hydrostatic drive assembly drivingly communicating with said axle assembly;

(d) a control handle, movement of said walk-behind snow blower apparatus being controlled by an operator through said handle; and (e) a user input device controllingly attached to said hydrostatic drive assembly, said user input device being a handle which effects control movements by pivoting said handle about an axis of pivotation, said handle having a resting, neutral position, and a maximum forward position, and said handle being continuously variably movable between said resting, neutral position and said maximum forward position, said walk-behind snow blower apparatus being movable in a first, forward direction of travel at speeds which are continuously variable between a first relatively slower speed of travel and a second substantially faster speed of travel, and multiple intermediate speeds between the first and second speeds, said user input device and said hydrostatic drive assembly, in combination, being adapted and configured to adaptively control said walk-behind snow blower apparatus based on a user input applied to said user input device which continuously variably and adaptively influences and/or controls the real time speed of travel of said walk-behind snow blower apparatus.

11. The walk-behind snow blower apparatus of claim 10 wherein the magnitude of the distance by which said handle is displaced from said resting, neutral position corresponds to the magnitude of the speed at which said walk-behind snow blower travels whereby pivotation of said handle a relatively greater distance from said resting, neutral position corresponds to a correspondingly greater rate of speed at which said walk-behind snow blower travels.

* * * * *